US006192631B1

(12) United States Patent
Kenkel et al.

(10) Patent No.: US 6,192,631 B1
(45) Date of Patent: Feb. 27, 2001

(54) WINDOW RETENTION SYSTEM

(75) Inventors: Terry J. Kenkel, Des Moines; Michael J. Billingsley, Cumming, both of IA (US)

(73) Assignee: EMCO Enterprises, Inc., Des Moines, IA (US)

( * ) Notice: Subject to any disclaimer, the term of this patent is extended or adjusted under 35 U.S.C. 154(b) by 0 days.

(21) Appl. No.: 09/473,322

(22) Filed: Dec. 28, 1999

Related U.S. Application Data

(62) Division of application No. 08/984,340, filed on Dec. 3, 1997, now abandoned.
(60) Provisional application No. 60/054,311, filed on Jul. 31, 1997.

(51) Int. Cl.[7] ..... E06B 3/00
(52) U.S. Cl. ..... 49/501; 49/482.1; 52/204.69; 52/204.62
(58) Field of Search ..... 49/501, 482.1; 52/204.69, 204.62, 204.7

(56) References Cited

U.S. PATENT DOCUMENTS 3,975,881 * 8/1976 Ninowski ..... 49/501 X
4,042,004 * 8/1977 Kwan ..... 49/141 X
4,479,331 * 10/1984 Bertolami et al. ..... 52/204.69 X
5,687,518 * 11/1997 Endo et al. ..... 49/501 X

FOREIGN PATENT DOCUMENTS

2131860 * 6/1984 (GB) ..... 52/204.69
2227275 * 7/1990 (GB) ..... 52/204.7

* cited by examiner

*Primary Examiner*—Jerry Redman
(74) *Attorney, Agent, or Firm*—Zarley, McKee, Thomte, Voorhees & Sease

(57) ABSTRACT

A window retention system includes a door frame having an exterior panel, an interior panel, an opening therethrough defining an inner peripheral channel, the exterior panel includes an upright portion extending along the channel so as to be directed toward the interior panel; and a resiliently flexible window retainer strip yieldably interlocked with and thereby detachably mounted on the door frame. The retainer strip has a longitudinal axis and a first upright portion spaced from and in opposing relation with the upright portion of the exterior panel so as to delimit a first track in the channel and retain the window element therein. The strip includes a second upright portion laterally spaced from the first upright portion. The second upright portion is biased towards and yieldingly interlocks with the channel. A flange extends from the first upright portion of the strip to engage one of the door frame panels and thereby secure the first upright portion of the strip against rotation in a vertical plane. The retainer strip can be adapted to achieve full view, self-storing, and triple track window mountings in a variety of door frames, some of which utilize snap-in liners.

14 Claims, 33 Drawing Sheets

WINDOW RETENTION SYSTEM

CROSS-REFERENCE TO RELATED APPLICATIONS

This application is a divisional of U.S. patent application Ser. No. 08/984,340 filed Dec. 3, 1997, now abandoned, which claimed the benefit of U.S. Provisional Application No. 60/054,311 filed Jul. 31, 1997.

BACKGROUND OF THE INVENTION

The present invention relates to the field of doors, more particularly to doors commonly referred to as "storm doors" for exterior entryways. Such doors typically include one or more window elements (glass-like plates, screens, vents, blinds and the like) which must be retained in the door frame during use, but whose removal may be desired for cleaning or other purposes. This invention provides a unique and versatile window retention system for doors.

Conventional storm doors often provide one or more window elements which are movable within a single door frame. Certain storm doors even provide window elements which are removable and interchangeable. The same is true for windows that are not included in a storm door. However, storm doors have some inherent problems that have heretofore been difficult to overcome. For instance, the window elements tend to deflect easily in the wind because of their relatively large surface. Typically, large amounts of weather stripping must be applied to the window elements and/or the door frame to fill the gaps.

Another problem is that movable window elements in conventional storm doors are typically rectangular and are supported or held only at their four corners. Thus, the intervening edges extend unsupported and are subjected to deflection due to the wind. In addition to the obvious problem of energy inefficiency, the unsupported edges may rattle against the door frame or other adjacent structures. Furthermore, moving the window elements can be precarious and unpredictable. A pair of swivel pins typically protrude from the upper corners of the movable window element and a pair of spring loaded latches are laterally extensible from the bottom corners. Both the pins and latches utilize a pair of vertical slots with a series of vertically spaced apertures extending through the liner, if one is present, and into the door frame. When the latches are withdrawn from the slots in order to move the window element, only the pins at the top secure the window element. The bottom of the window element tends to swing out of its track and toward the user. As a result, the top of the window and the pins therein can unexpectedly slide downwardly. Because the window element is supported in only four places and the contact areas are relatively small, the movement of the window element in its track tends to be sudden and unpredictable.

A primary objective of this invention is the provision of a universal system for detachably retaining window elements in a door.

Another objective of this invention is the provision of a window retention system which allows window elements to be snapped/released into place from one side of the door.

Another objective of this invention is the provision of a window retention system which allows window elements to be inserted into the door without the use of tools.

Another objective of this invention is the provision of a universal snap-in jamb liner which can accommodate either a self-storing or triple track window element set.

Another objective of this invention is the provision of a retainer strip which removably interlocks with a door frame or liner to retain a window element such that deflection of the window element by wind forces is minimized.

Another objective of this invention is the provision of a window retention system in which the window elements can be slidably raised and lowered without releasing any portion of the window element from horizontal retention.

Another objective of this invention is the provision of a window retention system which has fewer component parts while still providing a broad spectrum of products.

Another objective of this invention is the provision of a window retention system which is economical to manufacture, durable, flexible and reliable in use.

These and other objectives will be apparent from the description and claims which follow in view of the drawings.

SUMMARY OF THE INVENTION

The present invention relates to a window retention system for doors. The system adapts to various door frames and allows components, including window elements, to be installed and removed without tools. The system includes: a door frame having a window opening therethrough; a set of liners for the window opening; and retainer strips which are interposable between the window elements, the liners, and/or the frame so as to retain the window elements in the door frame.

Some opposing liners can be spring-loaded to yieldingly retain and center the window elements therebetween. This adjustable tension system yields more predictable sliding action for the window elements while greatly simplifying assembly. Window elements can be installed, removed and interchanged with greater ease.

Another aspect of this invention is the structure of the retainer strip which springingly and removably interlocks with the liner or the door frame to retain the window element(s) thereon. Once released against the liner or the door frame, the retainer strip provides a counter-acting force against the wind which might otherwise deflect the window element. The configuration of the retainer strip and its placement are adaptable to a variety of applications with minor changes. Similar strips can be used in door frames with liners, without liners, with single window elements, and with multiple window elements.

BRIEF DESCRIPTION OF THE DRAWINGS

FIG. 1 is a front elevation view of the exterior of a storm door having one embodiment of the present invention.

FIG. 2 is a vertical sectional view of the door taken along line 2—2 in FIG. 1. The view has been broken to conserve space and show indeterminate length.

FIG. 3 is a horizontal sectional view of the door taken along line 3—3 in FIG. 1. The view has been broken to conserve space and show indeterminate length.

FIG. 4 is an enlarged sectional view of the area denoted 4—4 in FIG. 2.

FIG. 5 is an enlarged sectional view of the area denoted 5—5 in FIG. 2.

FIG. 6 is an enlarged sectional view of the area denoted 6—6 in FIG. 2.

FIG. 7 is an enlarged sectional view of the area denoted 7—7 in FIG. 3.

FIG. 8 is a front elevation view of the exterior of a molded storm door having the triple track embodiment of this invention.

FIG. 9 is an enlarged vertical sectional view taken along line 9—9 in FIG. 8. The view has been broken to conserve space and show indeterminate length.

FIG. 10 is an enlarged horizontal sectional view taken along line 10—10 in FIG. 8. The view has been broken to conserve space and show indeterminate length.

FIG. 11 is an enlarged sectional view of the area denoted 11—11 in FIG. 9.

FIG. 12 is an enlarged sectional view of the area denoted 12—12 in FIG. 9.

FIG. 13 is an enlarged sectional view of the area denoted 13—13 in FIG. 9.

FIG. 14 is an enlarged sectional view of the area denoted 14—14 in FIG. 10.

FIG. 15 is a front elevation view of the exterior of a "full view" molded storm door.

FIG. 16 is a vertical sectional view of the door taken along line 16—16 in FIG. 15. The view has been broken to conserve space and show indeterminate length.

FIG. 17 is a horizontal sectional view of the door taken along line 17—17 in FIG. 15. The view has been broken to conserve space and show indeterminate length.

FIG. 18 is an enlarged sectional view of the area denoted 18—18 in FIG. 16.

FIG. 19 is an enlarged sectional view of the area denoted 19—19 in FIG. 16.

FIG. 20 is an enlarged sectional view of the area denoted 20—20 in FIG. 17.

FIG. 25 is a front elevation view of a full view extruded door frame having "self-storing" window elements retained therein by the retention system of the present invention.

FIG. 26 is a vertical sectional view taken along line 26—26 in FIG. 25. The view has been broken to conserve space and show indeterminate length.

FIG. 27 is a horizontal sectional view taken along line 24—24 in FIG. 22. The view has been broken to conserve space and show indeterminate length.

FIG. 28 is an enlarged sectional view of the area denoted 28—28 in FIG. 26.

FIG. 29 is an enlarged sectional view of the area denoted 29—29 in FIG. 26.

FIG. 30 is an enlarged sectional view of the area denoted 30—30 in FIG. 26.

FIG. 31 is an enlarged sectional view of the area denoted 31—31 in FIG. 27.

DETAILED DESCRIPTION OF THE PREFERRED EMBODIMENT

Figure 1:
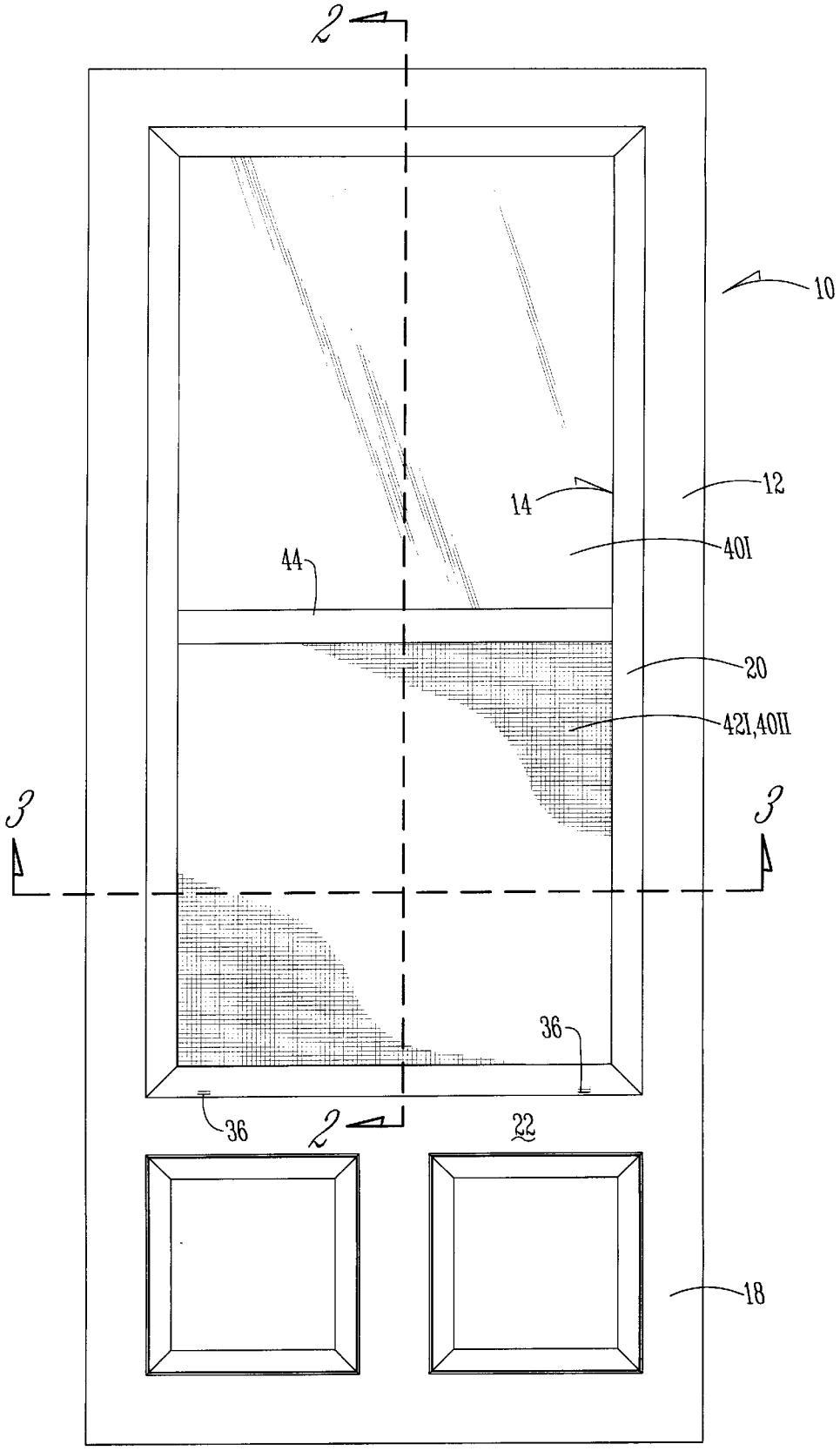
FIGS. 1–7 show an embodiment of this invention applied to a molded storm door with "self-storing" window elements.

The present invention will be described as it applies to its preferred embodiments, but it is not intended that the present invention be limited to the described embodiments. It is intended that the invention cover all alternatives, modifications, and equivalencies which may be included within the spirit and scope of the invention.

In the drawings and the description which follows, like structures are referenced with like reference numerals. Some cross-hatching may have been omitted from certain cross-sectional views where including such cross-hatching would have made the drawings too cluttered to be readable.

There are two main embodiments of this invention: one is applicable to a door frame referred to as the UltraCore™, and the other is applicable to a door system referred to as the MaxxView™. The UltraCore™ door system has a door frame that is molded from a material known as sheet molding compound (SMC). The UltraCore™ door frame comprises molded exterior and interior panels joined together along inner and outer peripheral seams. With the present invention, three different combinations or configurations of window elements can be mounted in the UltraCore™ door frame: a single "full view" window element; multiple "self-storing" window elements; or multiple window elements in a "triple track" configuration.

The MaxxView™ door system has an extruded aluminum door frame which is unbroken by transverse seams. Two different combinations of window elements can be mounted in the MaxxView™ door frame: a single "full view" window element; and multiple "self-storing" window elements. The meanings of "full view", "self-storing" and "triple track" will be explained further below and will be understood in view of the drawings. The discussion below begins with the UltraCore™ embodiment and its sub-embodiments.

UltraCore Self-storing

Figure 2:
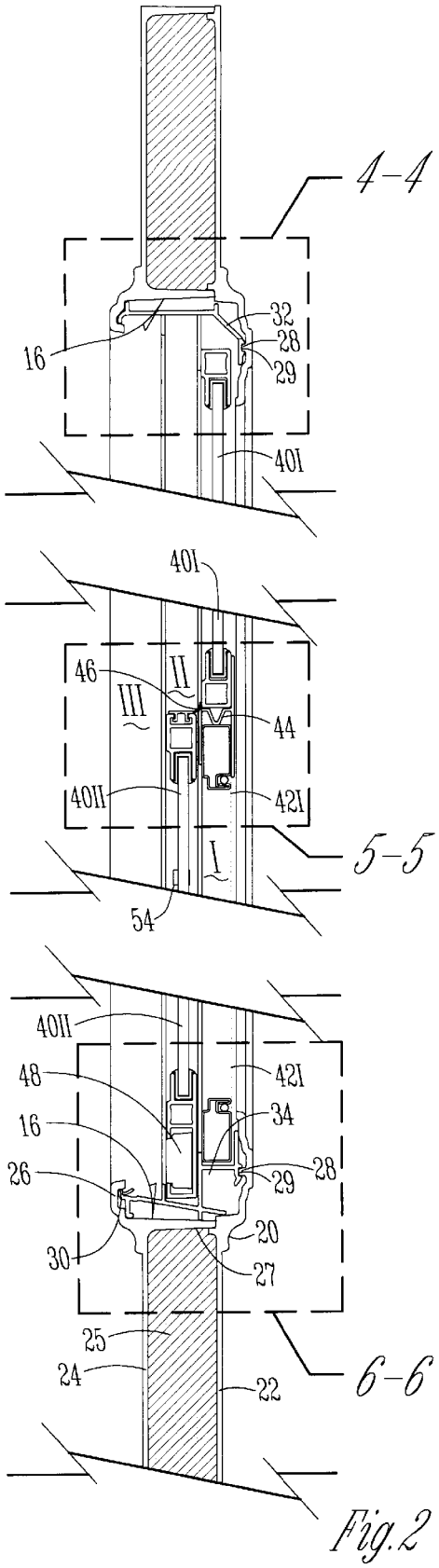
Figure 3:
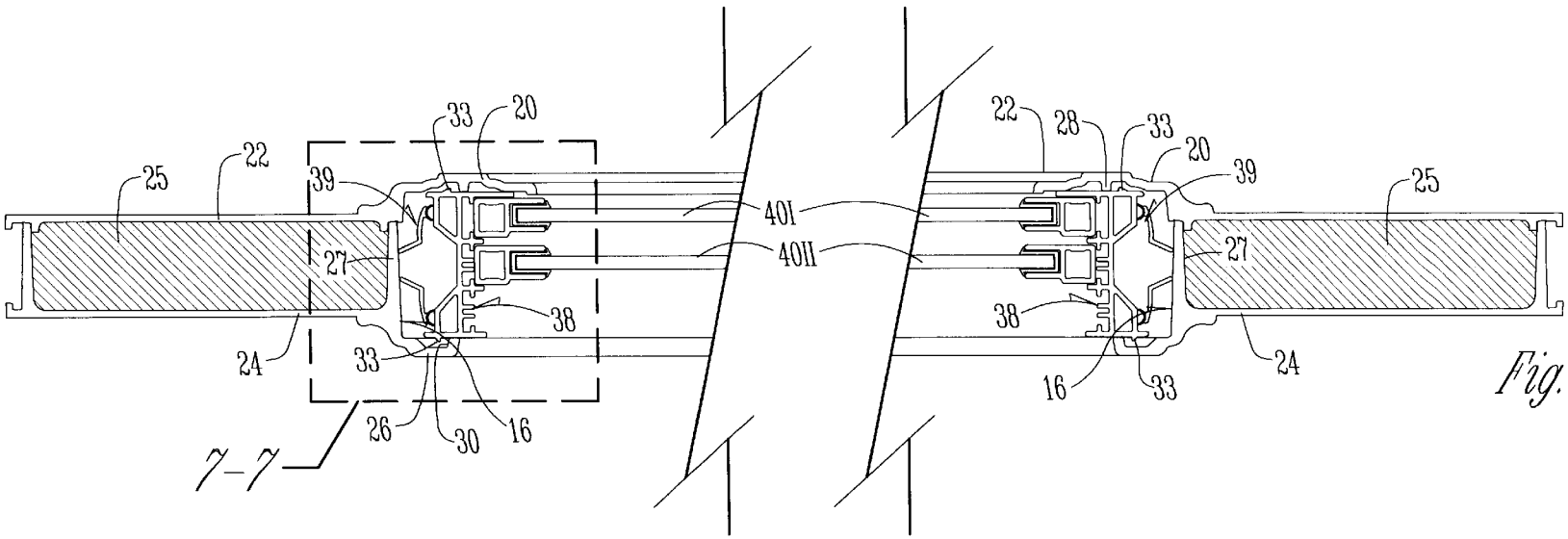

An UltraCore™ door system equipped with the present invention will now be described in detail below with reference to the drawings. In FIG. 1, an UltraCore™ door system 10 includes a door frame 12 having an opening 14 therethrough defining an inner peripheral channel 16 (FIGS. 2 and 3). Preferably, a kick panel 18 extends below the opening 14 such that the opening 14 extends over more than half but less than about three quarters of the height of the door 10.

The molded exterior panel 22 of the door frame 12 has molding member 20 integrally formed thereon. The molding member 20 extends peripherally around and into the window opening 14 so as to form the front portion of the channel 16.

The molding member 20 is decorative, but also assists in the function of retaining various window elements and components.

As best seen in FIGS. 2 and 3, the door frame 12 includes a molded interior panel 24 which includes an interior peripheral molding member 26 surrounding and extending into the opening 14. Preferably the interior molding 26 does not extend as far into the opening 14 as the exterior molding 20. This structure allows the window elements to be inserted into the door frame 12 from the interior side of the door 10, pase the interior molding 26. The exterior molding 20 limits the movement of the window elements in the direction of insertion.

Figure 4:
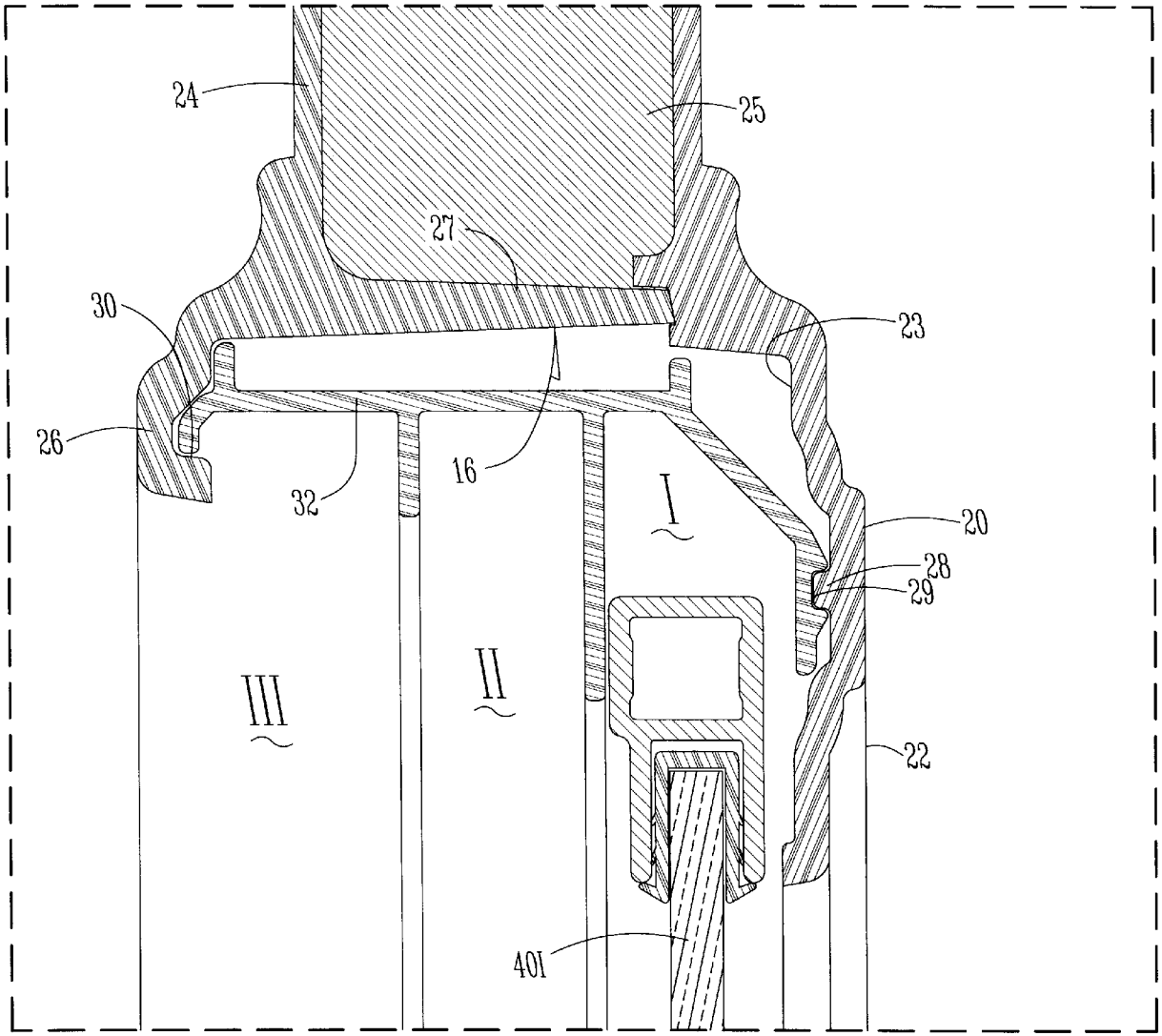

The interior panel 24 also includes a generally horizontal cross member 27 which is joined together with the exterior panel 22 to form a inner peripheral seam as shown. A similar seam and cross member can be provided along the outer periphery of the door frame 12 to form an outer peripheral seam. The space between the exterior and interior panels 22, 24 can be filled with an adhesive foam material 25 in a conventional manner. To the extent described above, the general construction of the door itself is conventional and therefore not the subject of this invention. However, the molding members 20,26 are integrally formed on their respective panels 22, 24. Furthermore, the exterior panel 22 has an interior-facing surface or wall 23 (see FIGS. 4, 6 and 7) with a tab or rib member 28 protruding therefrom towards the interior side of the door. The upper portion of the interior molding member 26 is curved inwardly so as to form a ledge 30 thereunder.

Substantially rigid liners 32, 34 snap interlockingly into the channel 16 at the top and bottom of the opening 14 respectively, as generally shown in FIGS. 2 and 3. Corresponding slots or groove 29 and protrusions or ribs 33 engage the rib member 28 and the ledge 30 respectively. The top liner 32 is commonly referred to as the head liner; the bottom liner 34 is commonly referred to in the art as the sill liner. The sill liner 34 is sloped from interior to exterior so as to provide for drainage of any moisture which may accumulate above the liner. The moisture is then drained to the exterior of the door 10 through one or more weep holes 36 (FIG. 1).

A pair of spring-biased, yieldable jamb liners 38 snap interlockingly into the channel 16 on either side of the opening 14. The jamb liners 38 are at least semi-rigid, but have a flexible spring mechanism 39 which yieldably spaces the liner 38 from the cross member 27 located at the jamb sides of the channel 16. The jamb liners 38 are similar to the wide track window jamb liner disclosed in U.S. Pat. No. 5,265,308 by May et al. and assigned to Intek Weatherseal Products, Inc. Thus, the jamb liners themselves are not the subject of this invention.

As best seen in FIGS. 4–7, the liners 32, 34 and 38 each have three concave tracks I, II, III formed therein. It is contemplated that other numbers of tracks are also possible. The tracks I, II, III are aligned with the corresponding tracks I, II, III on the adjacent liners which extend around the opening 14. Also see FIGS. 2 and 3. Various window elements can be slidably or stationarily mounted in the tracks I–III, including but not limited to a substantially rigid glass or plastic-based window 40, a screen 42, and a center mullion 44. In the drawings, the window elements are designated with combination reference numerals (40I, 40II, 42I) which identify the element, as well as the track in which it is initially located.

Figure 5:
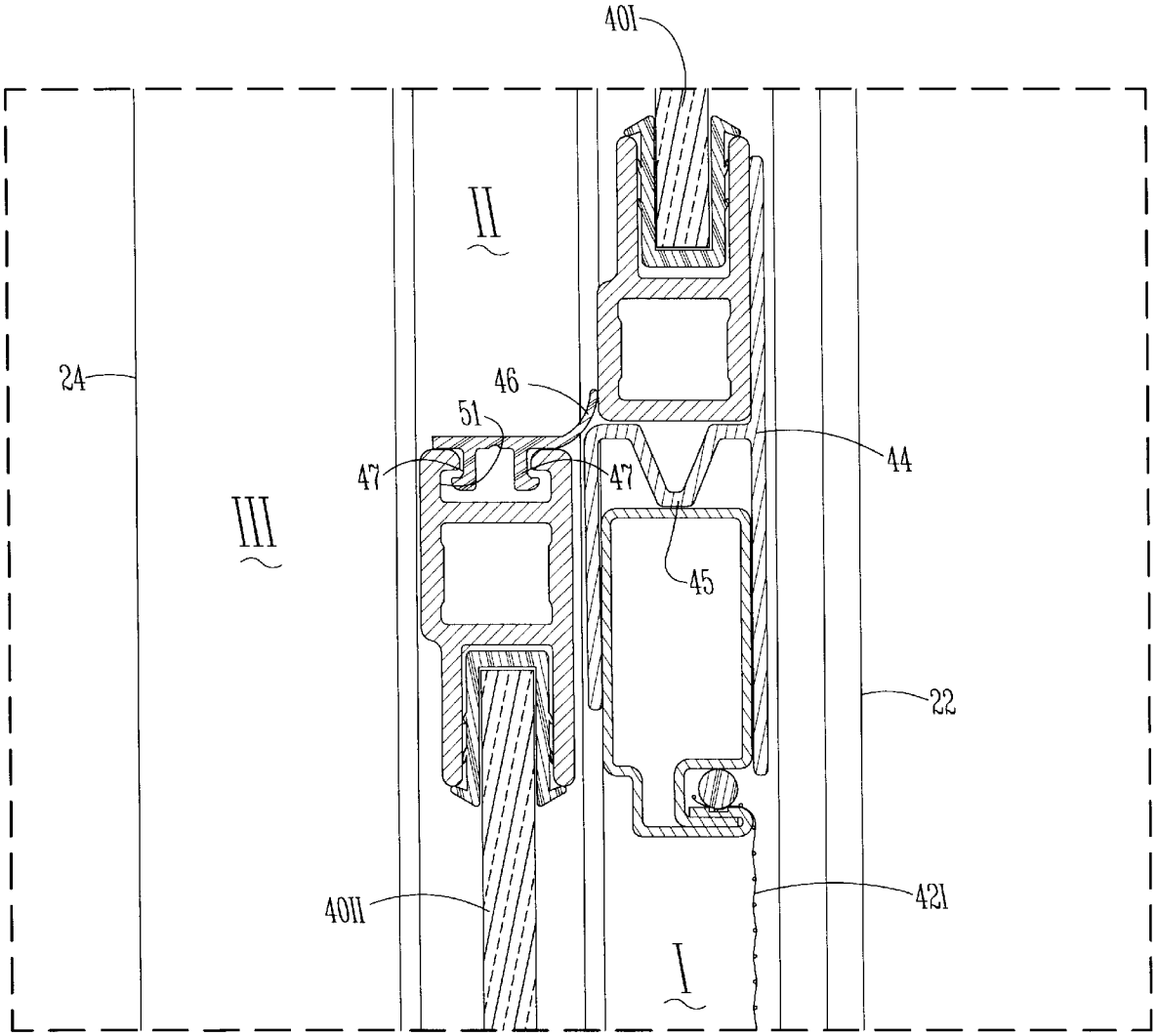

Legs 47 yielding and interlockingly snap a sealing member 46 into a channel 51 formed on the top of the lower window 40II, as best seen in FIG. 5. The free end of the sealing member 46 extends into sealing engagement with the frame of the upper window 40I.

The center mullion 44 is an h-shaped piece which mounts on the top of the screen 42I. Legs of the center mullion 44 extend respectively downwardly on the outside of the screen, downwardly on the inside of the screen 42I and the adjacent lower window 40II, and upwardly along the outside of the upper window 40I. The center mullion 44 has a V-shaped protrusion 45 extending downwardly between the upper window 40 and the screen 42. The protrusion establishes the desired spacing between the upper window 40I and the screen 42I.

Figure 6:
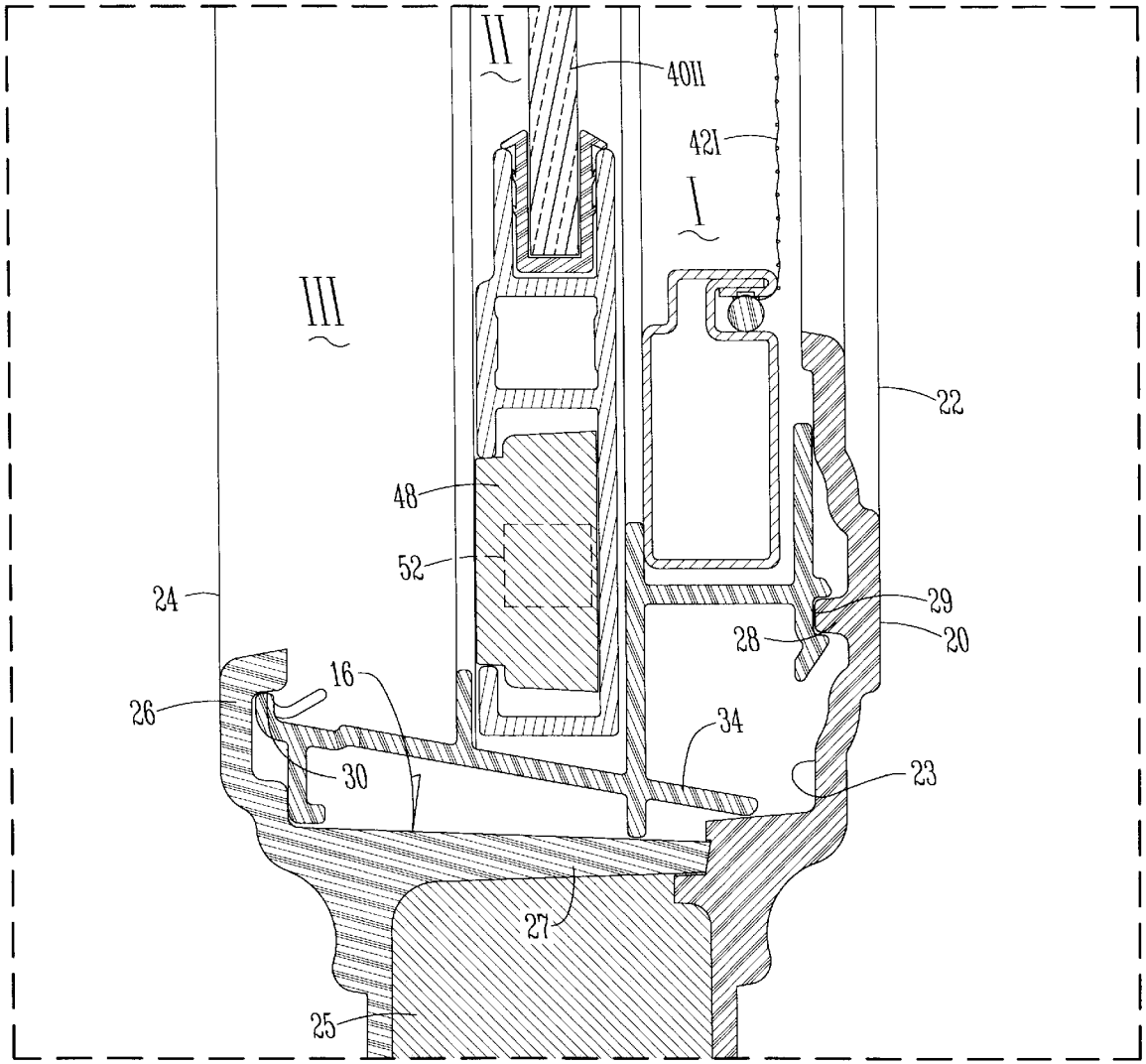
Figure 7:
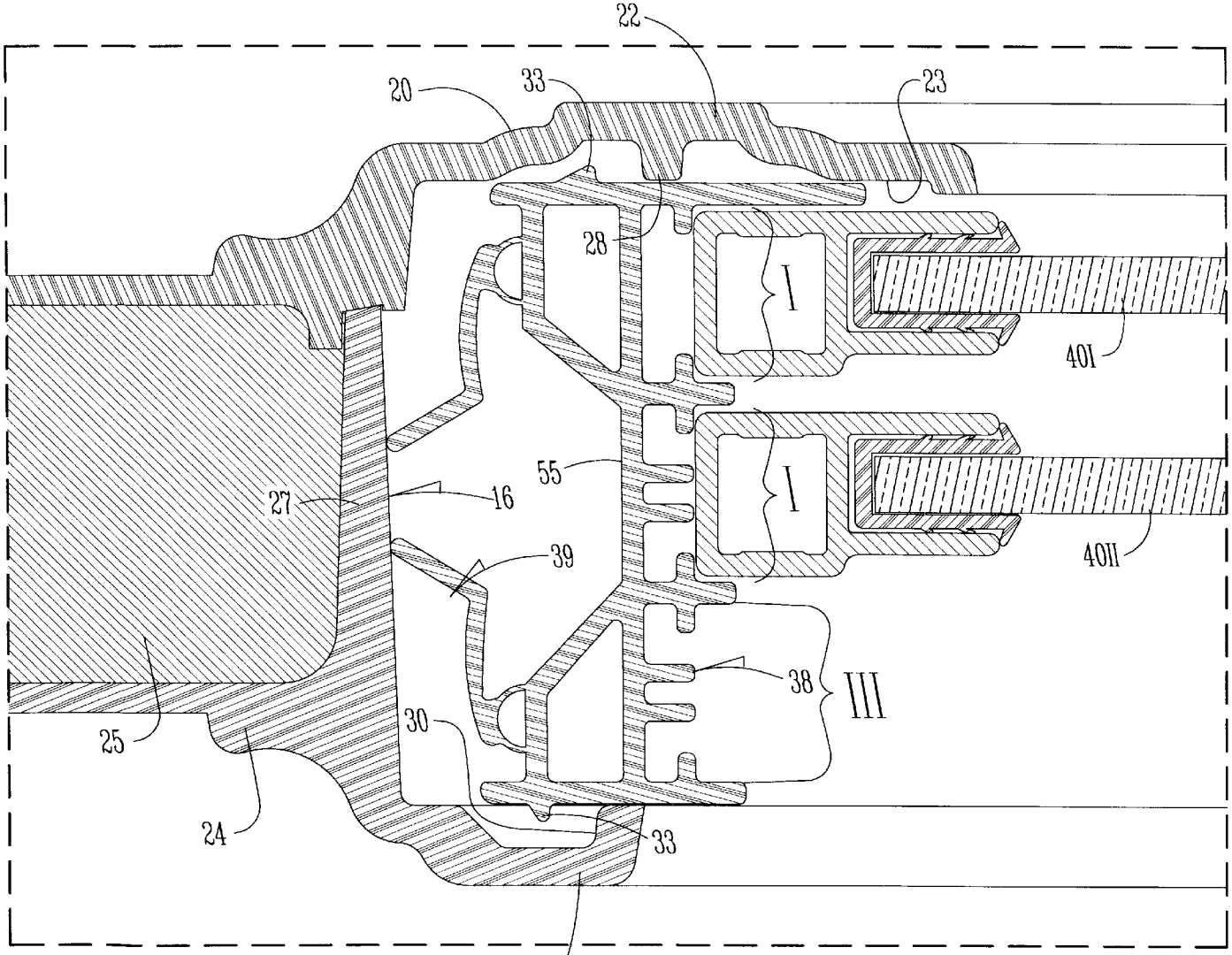
Figure 8:
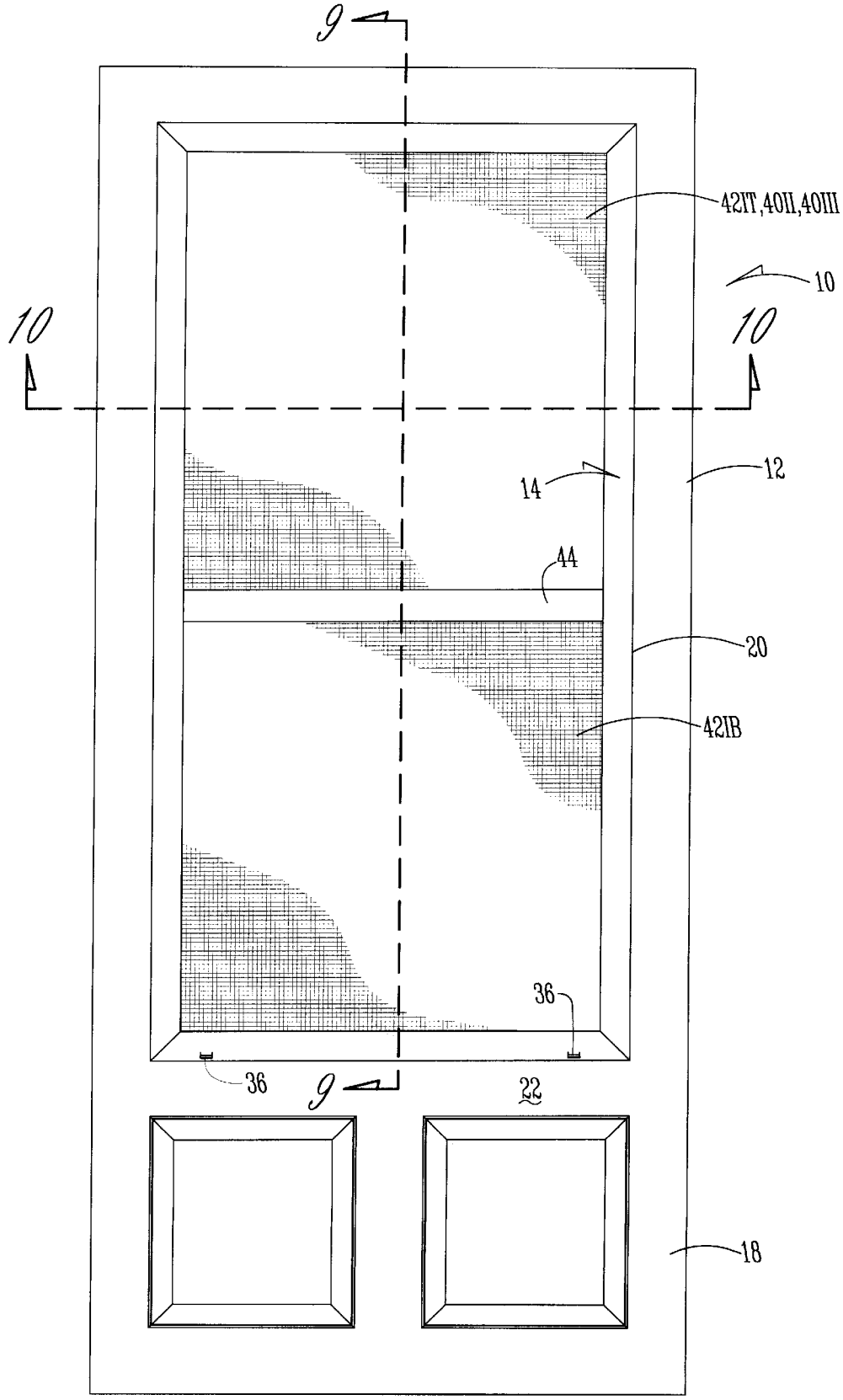
FIGS. 8–14 are similar to FIGS. 1–7 respectively, but show how the window retention system of this invention can also be applied to a "triple track" molded storm door which utilizes all three tracks of the window liner.
Figure 32:
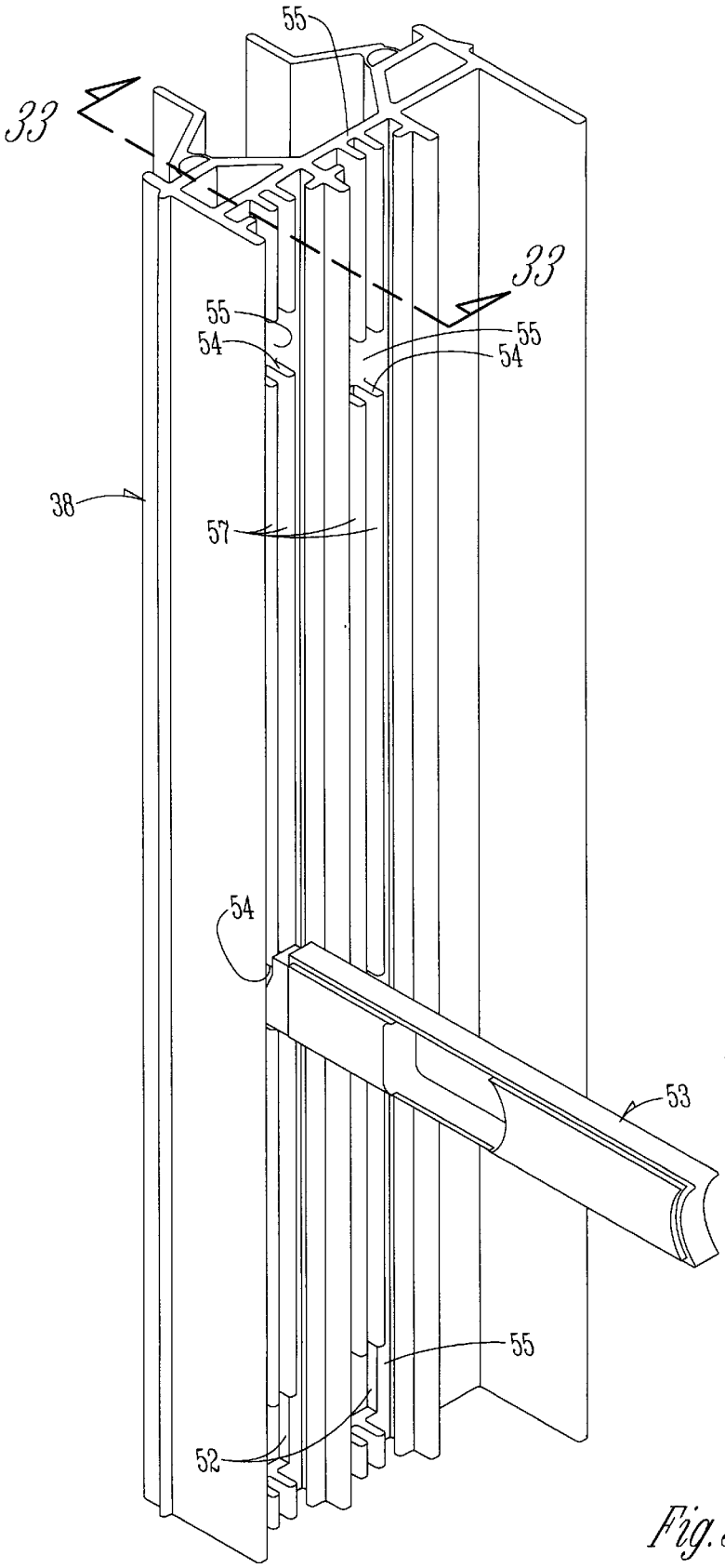
FIG. 32 is a perspective view of the latching mechanism of the present invention, including the latch bar and the jamb liner.

FIG. 6 shows that the lower window 40II is equipped with a pair of laterally movable latches 48 at its bottom two corners. The latches 48 are part of a latch mechanism which includes a latch bar 53 (FIGS. 32 and 33) that is normally biased into engagement with the jamb liner 38. For security reasons, one or more anti-lift latch holes 52 extend completely through the cross wall 55 of the jamb liner 38 and can fully receive the end of the latch bar 53. Releasing the latch bar 53 into the holes 52 prevents the window from being raised and thus locks the window element in the lowered position. The hole 52 does not extend into the door frame 12 like conventional doors which are therefore more costly to fabricate in this regard. Spaced apart depressions 54 extend through the longitudinal ribs or projections 57, but not through the cross wall 55. The depressions 54 are provided at predetermined intervals along the length of the jamb liners 38 so that the lower window 40II can be raised, lowered, and set at a variety of heights with a respect to the bottom of the opening 14. Preferably, the depressions 54 in adjacent tracks are vertically staggered, as shown, to ensure that the latch bar of the most exterior movable window element is accessible.

Figure 33:
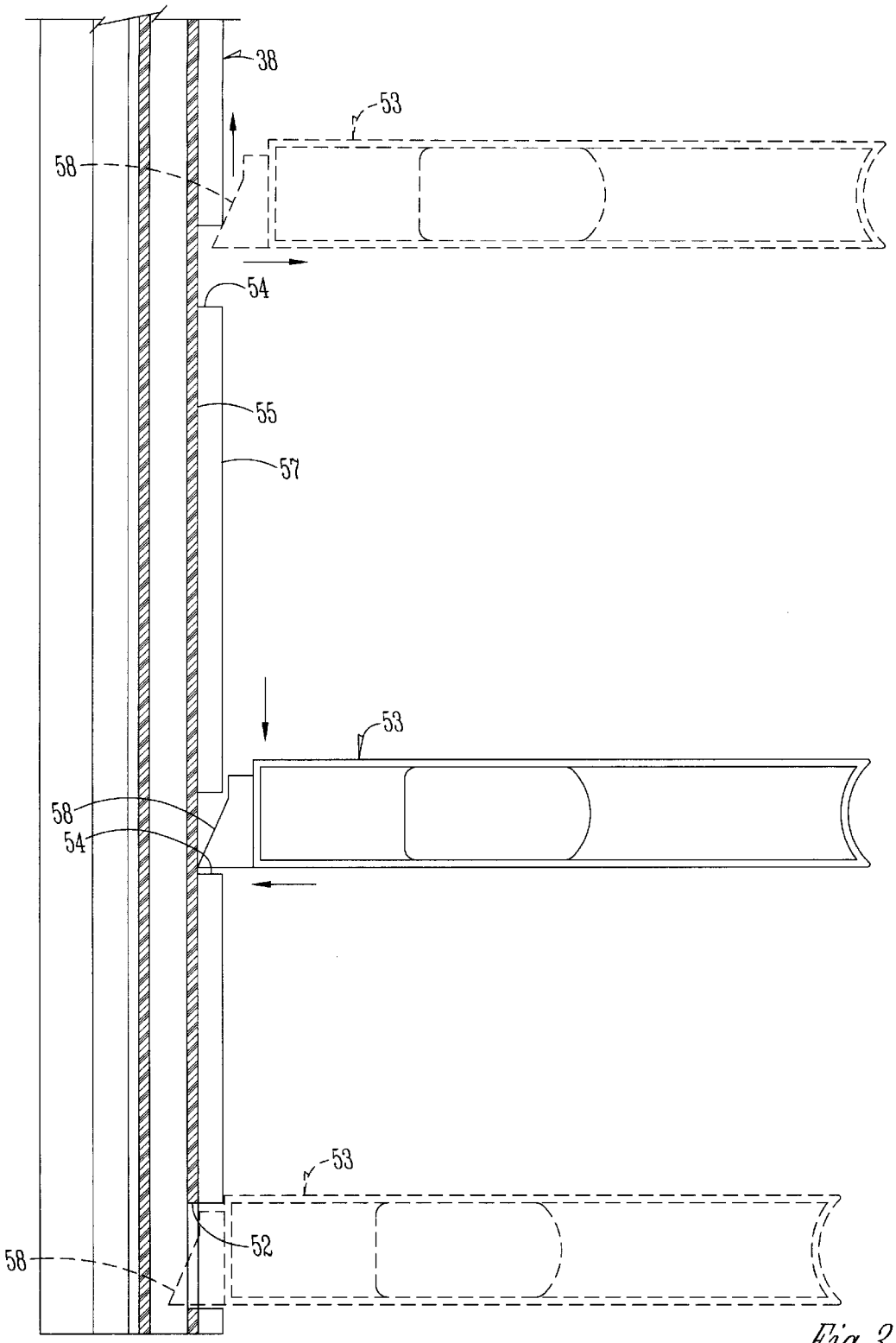
FIG. 33 is a vertical sectional view of the latching mechanism taken along line 33 in FIG. 32 showing how the latch bar and the jamb liner interact to provide the desired latching, locking and ratcheting characteristics.

As best seen in FIG. 33, the latch bar 53 has an end 58 that is beveled at an angle less than ninety degrees with respect to the longitudinal axis of the bar 53. As illustrated in the lower portion of FIG. 33, the latch bar 53 springs outwardly into any hole 52 or depression 54 that it encounters. The hole 52 receives both the straight and beveled portions of the latch bar 53 so that the window element to which the latch bar 53 is attached cannot move unless the bar is retracted.

The central portion of FIG. 33 illustrates in solid lines the position of the latch bar 53 when the window element is raised above the locked position and the latch bar 53 is released into one of the depressions 54. As the arrows indicate, the bar 53 springs into the depression 54 and the horizontal bottom surface of the bar end 58 prevents the latch bar 53 from moving downwardly under the weight of the window. The latch bar 53 must be manually fully retracted in order to lower the window element.

However, as shown by the upper portion of FIG. 33, the latch bar 53 and the window can be lifted without manually retracting the bar 53. Due to the beveled end 58, the upward force applied to the window urges the latch bar 53 to retract inwardly and disengage itself from the depression 54. When the latch bar 53 is not registered with the holes 52 or the depressions 54, the bar 53 can be released and the window can still be raised or lowered. The window raises with a ratcheting motion (and sound) as the latch bar 53 pops in and out of the depressions 54. Except when fully retracted, the latch bar 53 is always spring biased into engagement with the track. The window raises and lowers more consistently under these steady force conditions. The window is less likely to drop suddenly in the track.

In summary, from bottom to top, FIG. 33 shows the latch bar 53 locking, latching, and ratcheting.

Referring again to FIG. 6, the sill liner 34 has an elongated flexible sealing strip 50 disposed adjacent its interior edge so that a seal is provided on any window element which might be inserted into track III, like in the triple track embodiment described below.

With the spring mechanism 39 in the jamb liner 38, inserting the window elements into the door frame 12 is a relatively easy task. The user grabs the window element and inserts one side of it into the appropriate track I, II, III in one side of the opening 14. The spring mechanism 39 yields when the user pushes the edge of the window element toward the cross member 27 at one of the jamb sides. Then the other side of the window element can be rotated into the opening 14 and released into the appropriate jamb liner track I, II, III. The window element is held between the opposing spring loaded jamb liners 38.

In the UltraCore™ self-storing embodiment shown in FIGS. 1–7, the center mullion 44 is placed on the top of the screen 42 and that sub-assembly is inserted into the opening 14 as just described. Then, the upper window 40I is inserted and pivoted into place as shown in FIG. 2. Finally, the lower window 40II is similarly inserted and placed in the initial position shown in FIG. 2. The window elements 40, 42 are essentially tension fit into place by the jamb, head, and sill liners. Thus, the tracks II, III retain the window elements once they are inserted into the opening 14.

The lower window 40II can be moved with respect to the screen 42I and the upper window 40I by pulling the spring loaded latches 48 inwardly until they clear the holes 52 which extend through the jamb liners 38. Then the lower window 40II can be raised. Once the latches 48 are past the holes 52, pulling them to raise the window 40II is unnecessary., The latches 48 may be released outwardly into one of the sets of depressions 54 in the jamb liner 38. The window 40II is most securely locked when it is in the completely lowered position, where the latches 48 extend through the holes 52 through the jamb liners 38. This particular embodiment of the invention is referred to as a self-storing storm door because the lower window 40II is stored behind the upper window 40I when the lower 40II is raised.

One advantageous feature of the present invention is that, once inserted, the movable or lower window 40II is constantly restrained in its track by the edges of the jamb liners 38, even when the latches 48 are retracted. Thus, the latch end of the window 40II is not prone to the "swinging out" problem experienced in conventional window retention systems which utilize swivel pins at the upper corners of the window. The window raises and lowers in a smooth, predictable manner. The load is evenly spread around the side edges of the window 40. One reason the window moves so smoothly is that the jamb liners 38 are uniformly spring biased into frictional contact with its side edges. Gravity or other forces must overcome this built-in friction in order to accelerate the window or sash. The window 40 also deflects less during wind storms. The spring loaded jamb liners 38, head liner 32, and sill line 34 surround and support the window element on at least three sides. Further, the edges of the window element frames are generally captured on three sides. The amount of weather stripping can be reduced and a much stronger, weather resistant storm door results.

UltraCore Triple Track

FIGS. 8–14 disclose that a second configuration of window elements can be achieved with the UltraCore™ door frame 12. This configuration is referred to as the triple track system. The hardware utilized is very similar to the self-storing system shown in FIGS. 1–7. Thus, great flexibility and interchangeability is possible.

Figure 9:
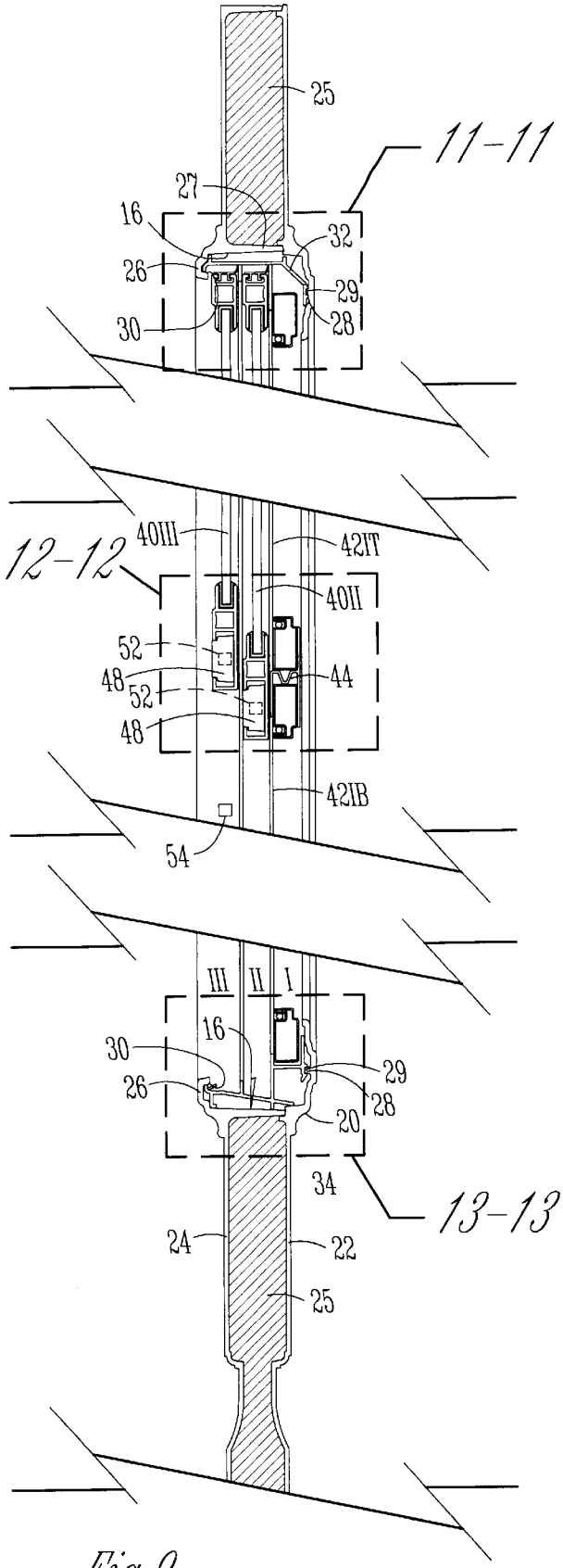
Figure 10:
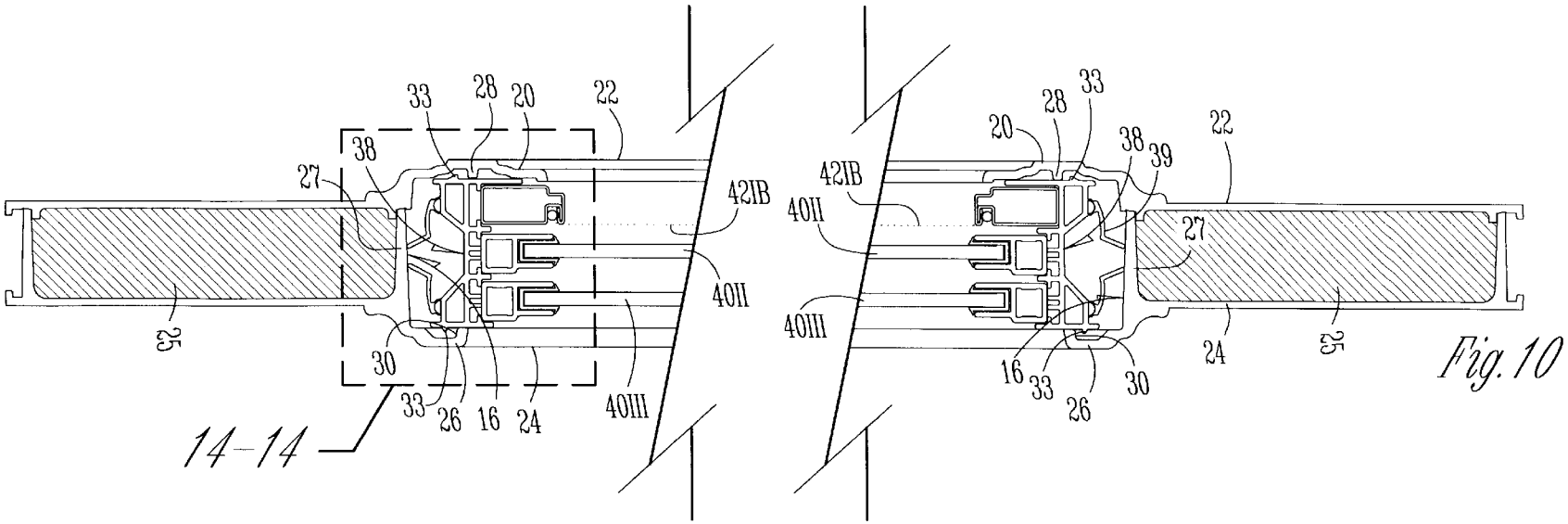
Figure 11:
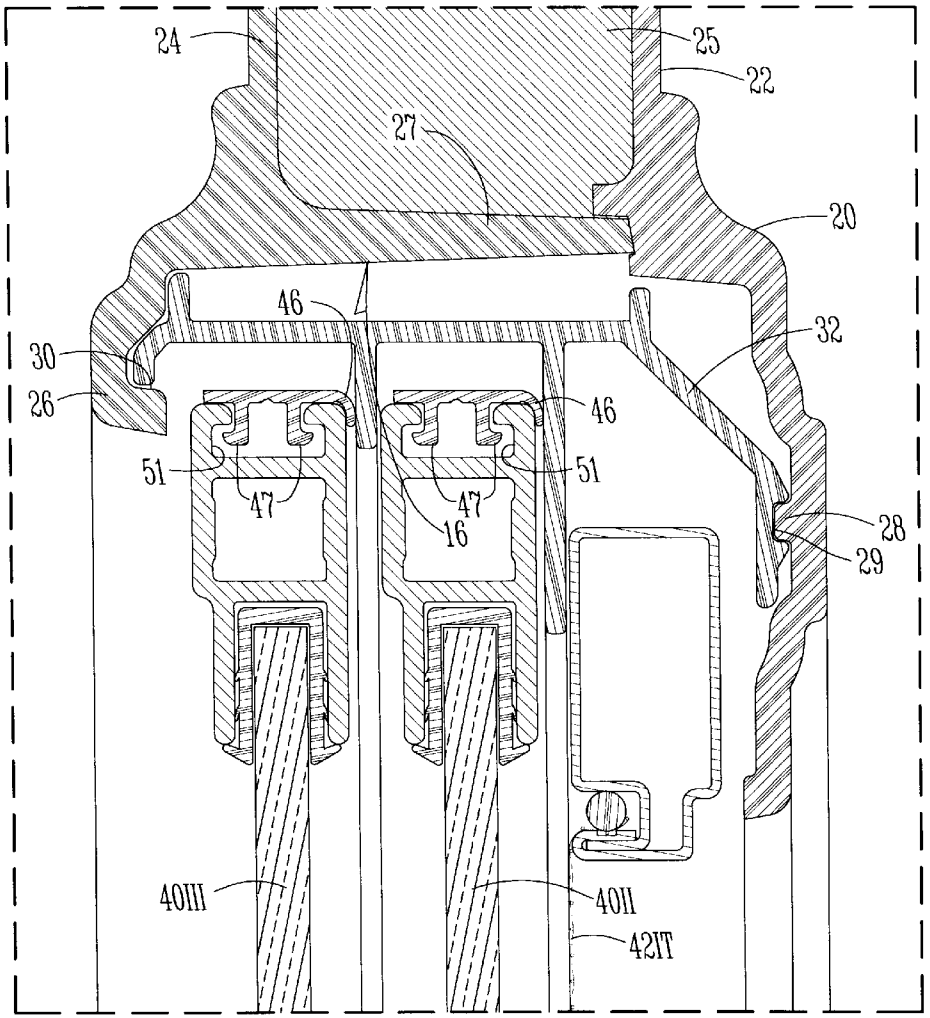
Figure 12:
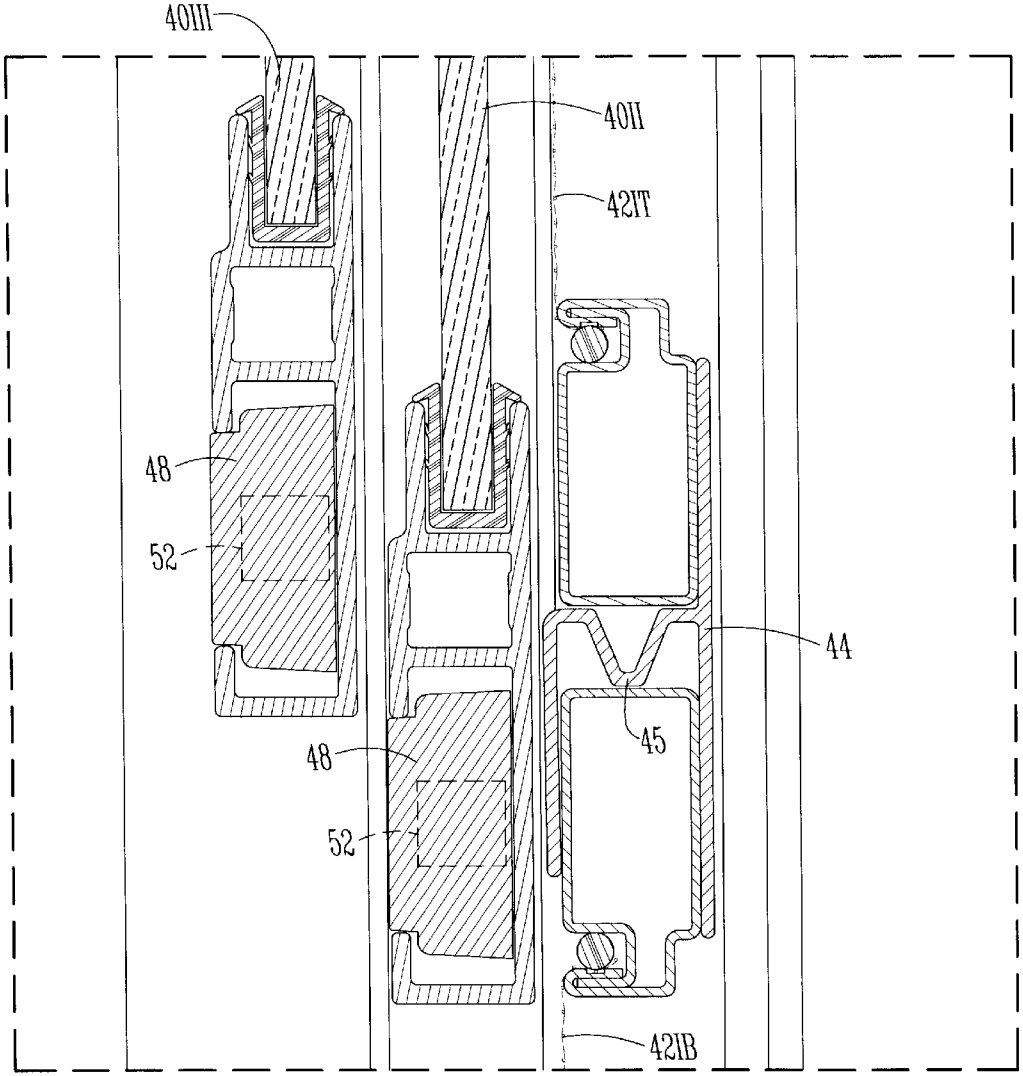
Figure 13:
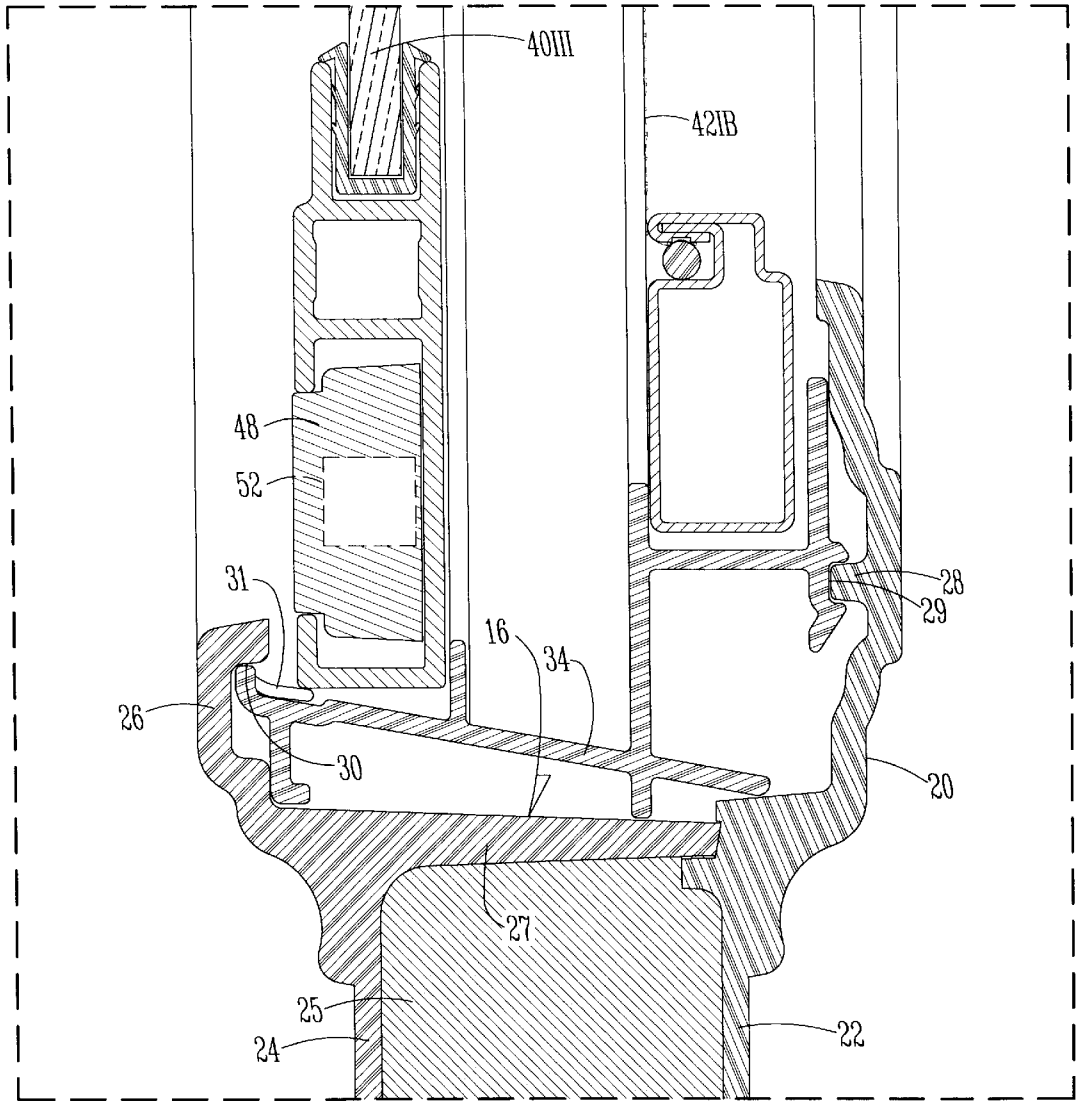
Figure 14:
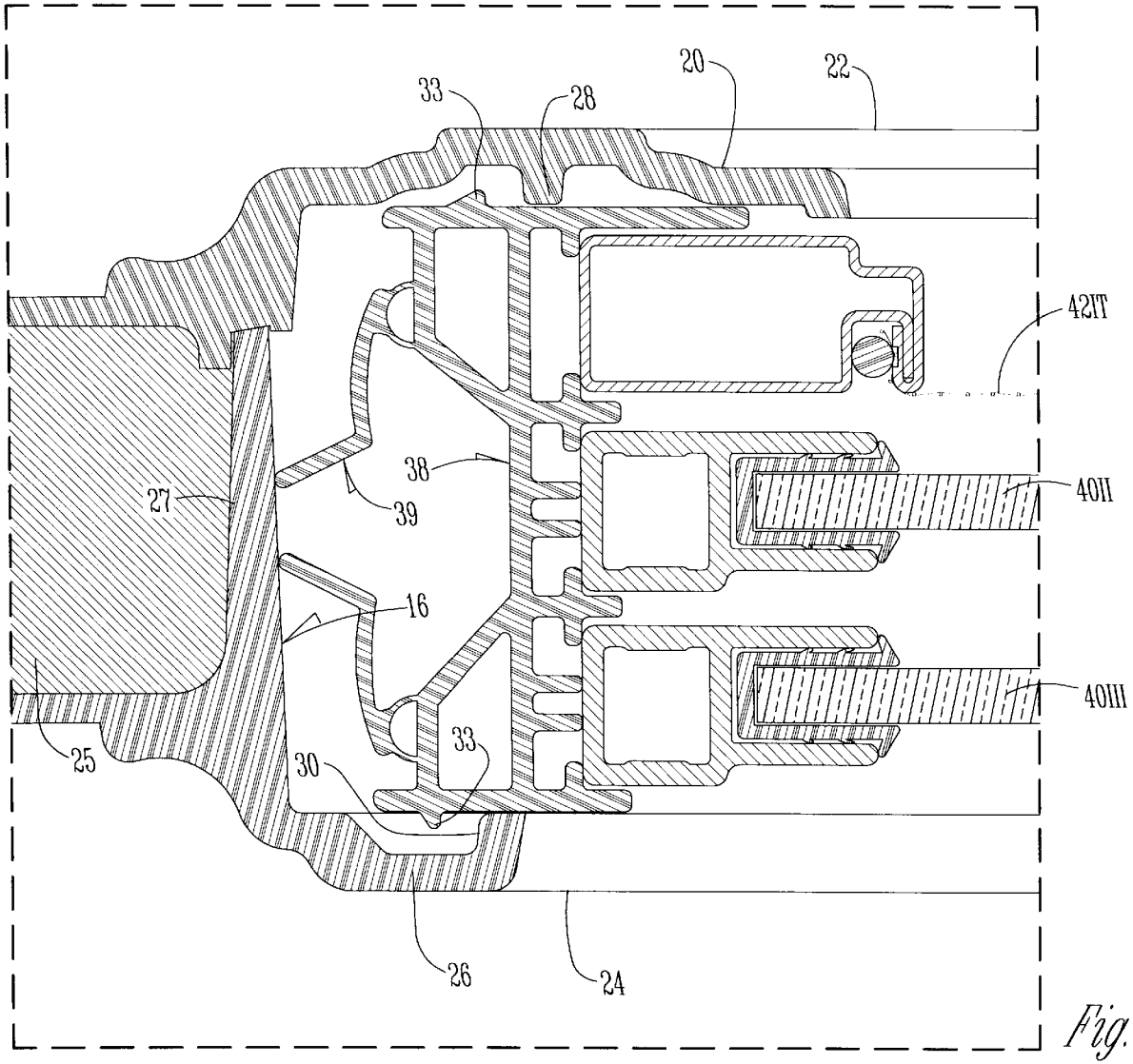

Referring to FIG. 9, in the triple track configuration, two screens 42IT, 42IB are installed in track I with the center mullion 44 in between them. Then a movable window 40II is placed in track II. A second movable window 40III is inserted in track III. Thus, the movable windows 40II and 40III can be positioned in fully raised or fully lowered position, or anywhere in between. This provides ventilation openings of adjustable size through one or more of the screens 42IT, 42IB. Referring to FIG. 11, a sealing member 46 snaps on the top of each of the windows 40II and 40III to discourage moisture from reaching the interior. In the triple track configuration, a seal member 31 extending from the liner 34 on the interior side of track III can contact the movable window 40III, as shown in FIG. 13, to further insure that moisture does not reach the interior of the door 10. Additional sealing members 46 are provided along the top of the movable windows 40II, 40III, as shown in FIG. 11. It should be apparent that the UltraCore self-storing and triple track configuration share the same liners. This makes conversions on the assembly line and in the dealer or consumer's hand very easy. Changing window elements, center mullions and seals may be all that is required. No tools are needed.

Figure 15:
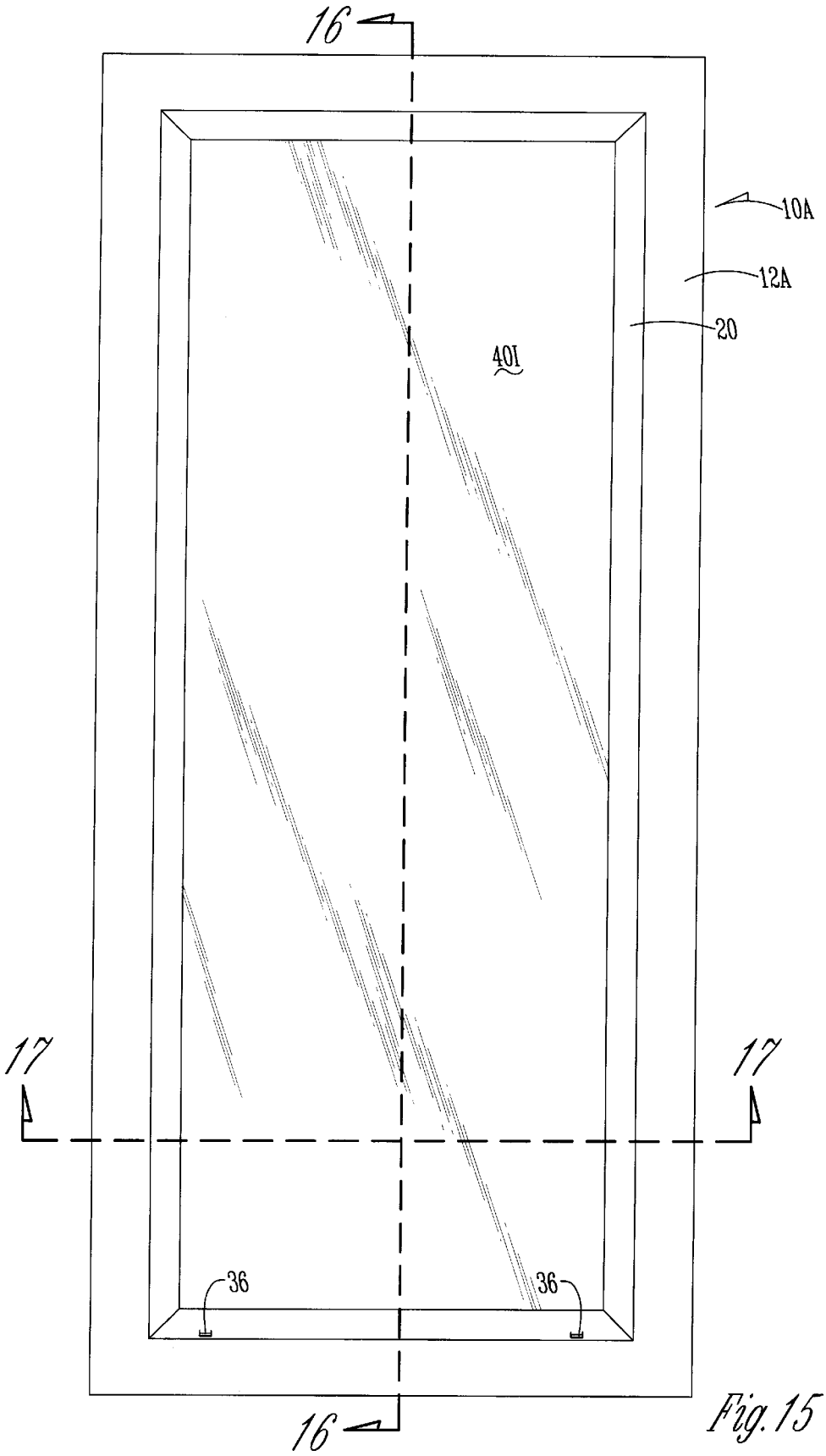
FIGS. 15–20 show the above-mentioned embodiment applied to a "full view" molded storm door.

UltraCore Full View FIGS. 15–20 illustrate what is referred to as a full view door system 10A of the UltraCorem type. Referring to FIG. 15, the door frame 12A is similar to the door frame 12, except a kick panel is not provided. Thus, the opening 14 occupies almost the entire area of the door 10A. However, the cross section of the door frame 12A immediately adjacent the opening 14 is the same as in FIG. 1–7. The full view configuration allows one to install a full length window or screen in the opening 14.

Figure 16:
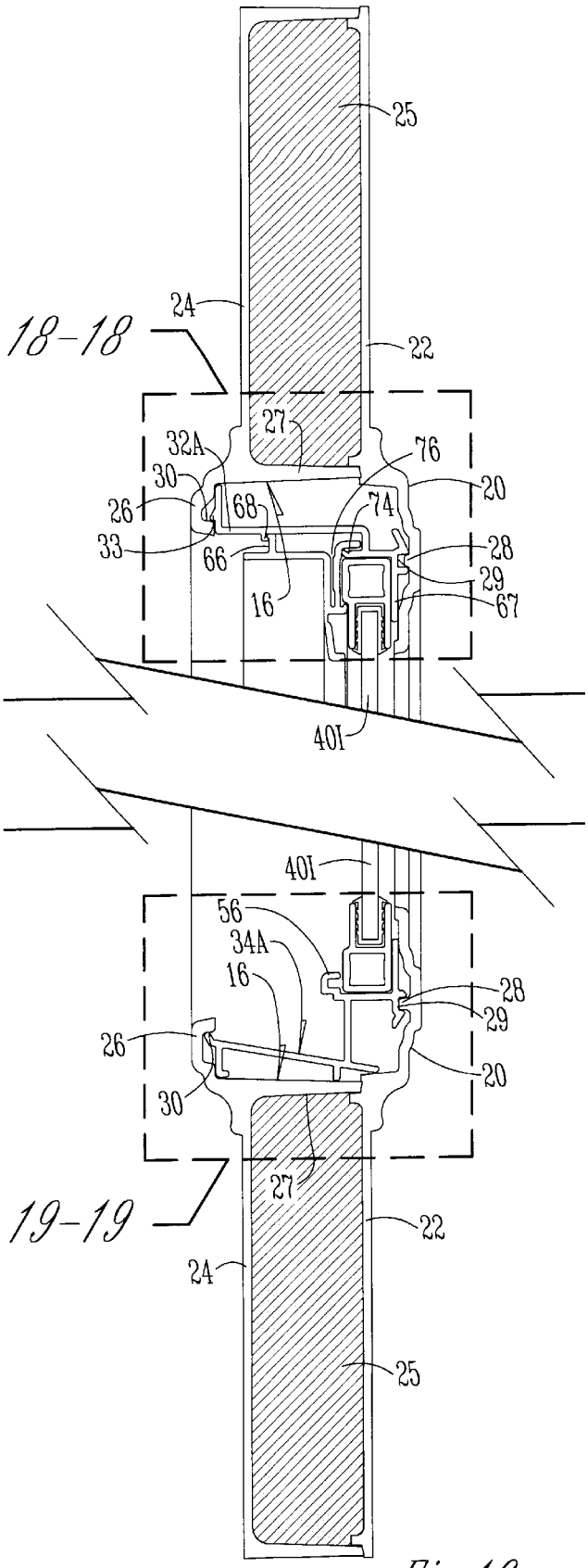
Figure 17:
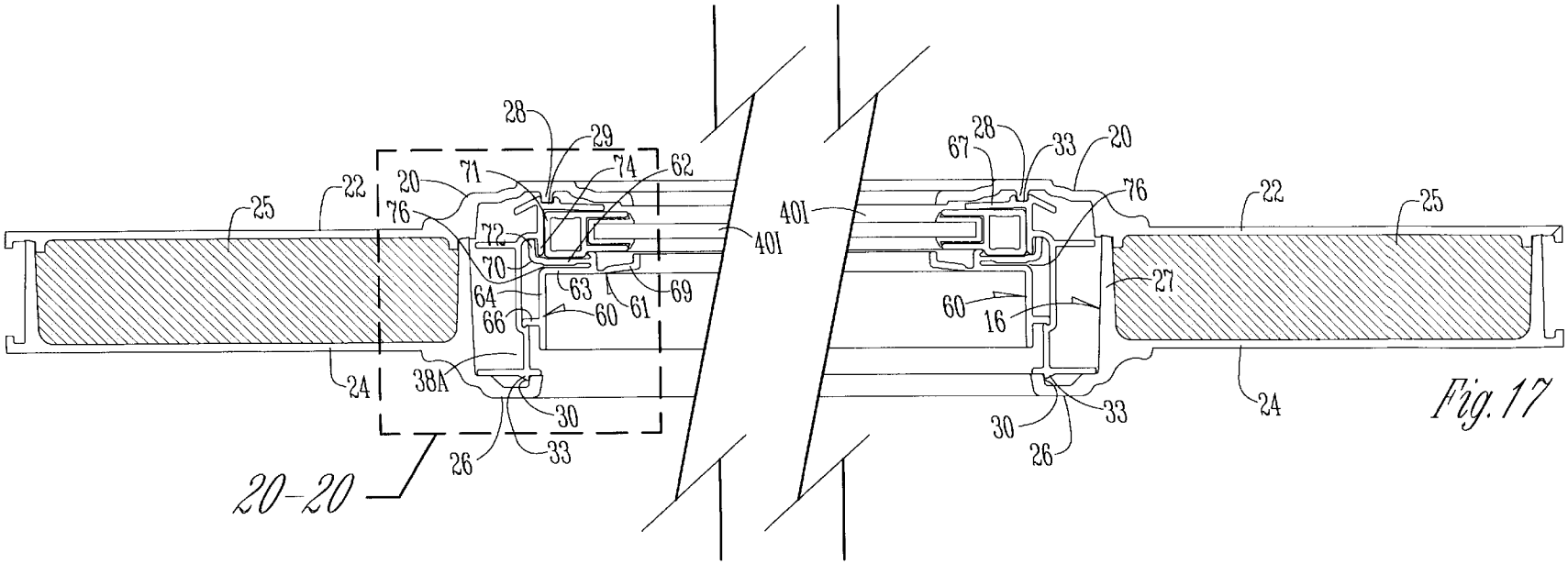
Figure 20:
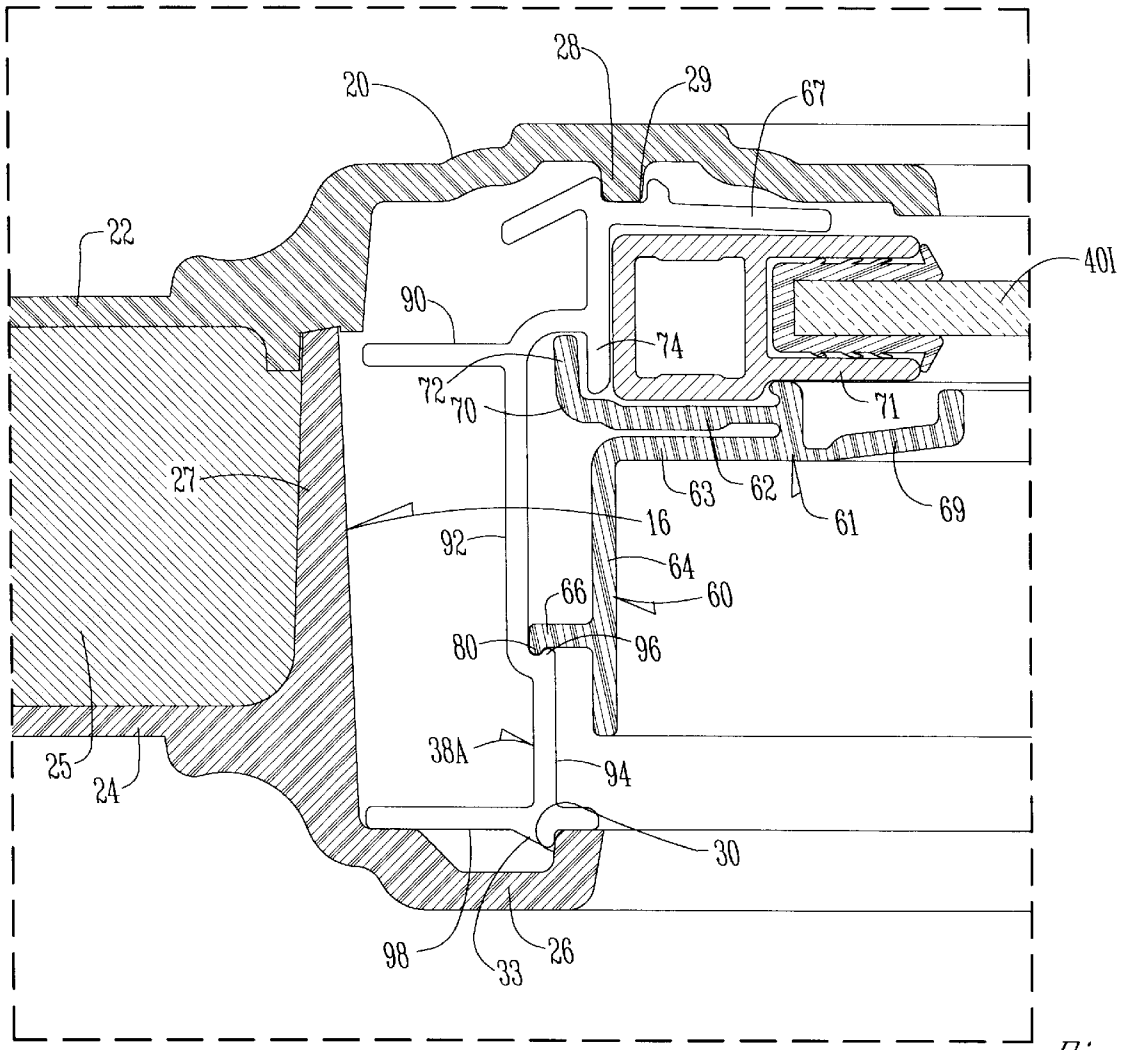
Figure 21:
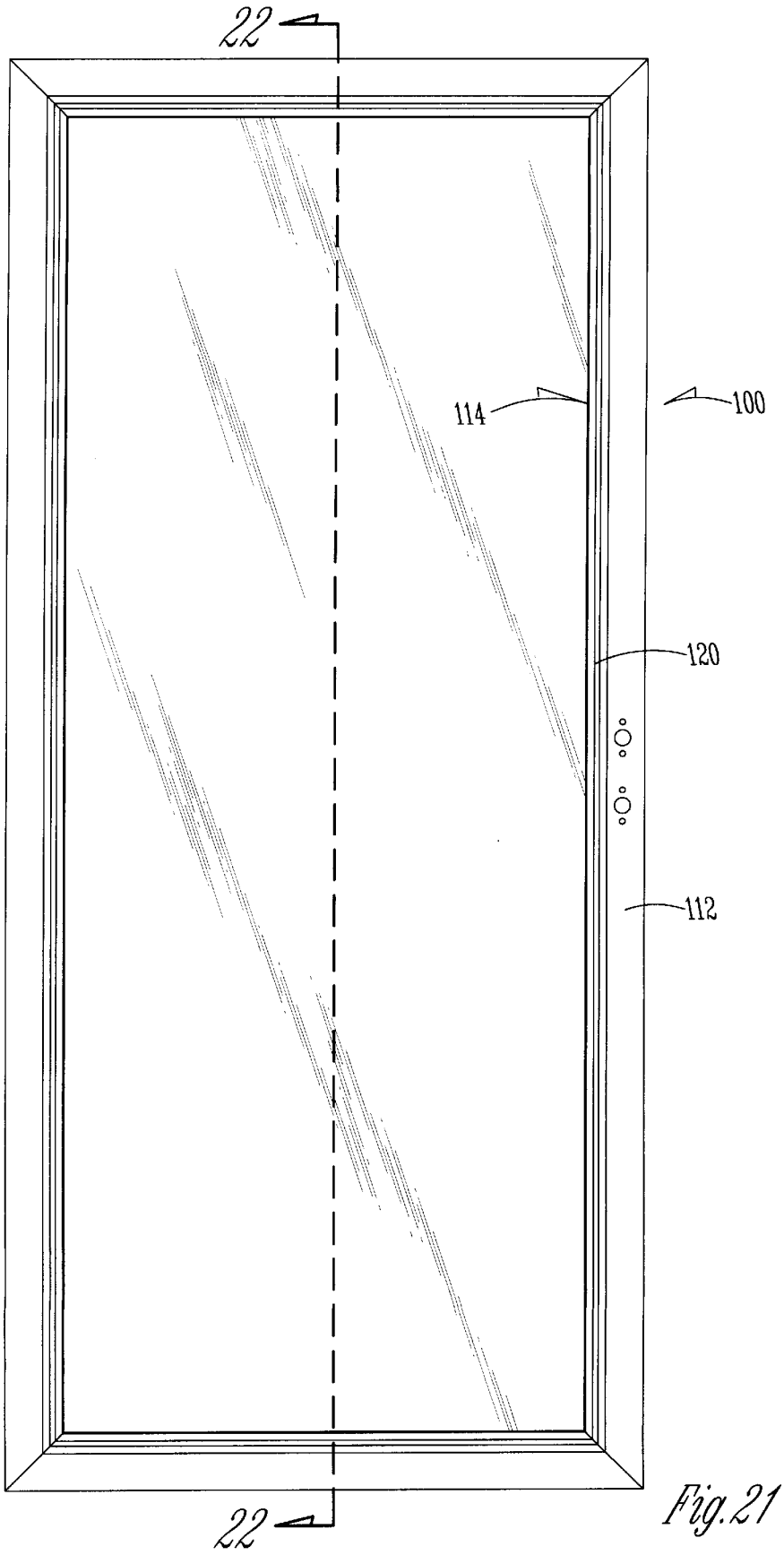
FIG. 21 is a front elevation view of the exterior of an extruded frame "full view" storm door having another embodiment of the window retention system of the present invention.

The head liner 32A and the sill liner 34A are shaped as shown in FIG. 16. Again, the sill liner 34A slopes downwardly toward the exterior for drainage purposes. Liners 38A are utilized on the jamb sides (FIGS. 17, 20). The detachable liners 32A, 38A yieldingly snap interlockingly into the channel 16 as shown and provide a single perimetrically elongated track for guidingly receiving and retaining a window element. The sill liner 34A has an integral retaining member or upright portion 56 thereon and thus does not require a separate retainer.

Figure 18:
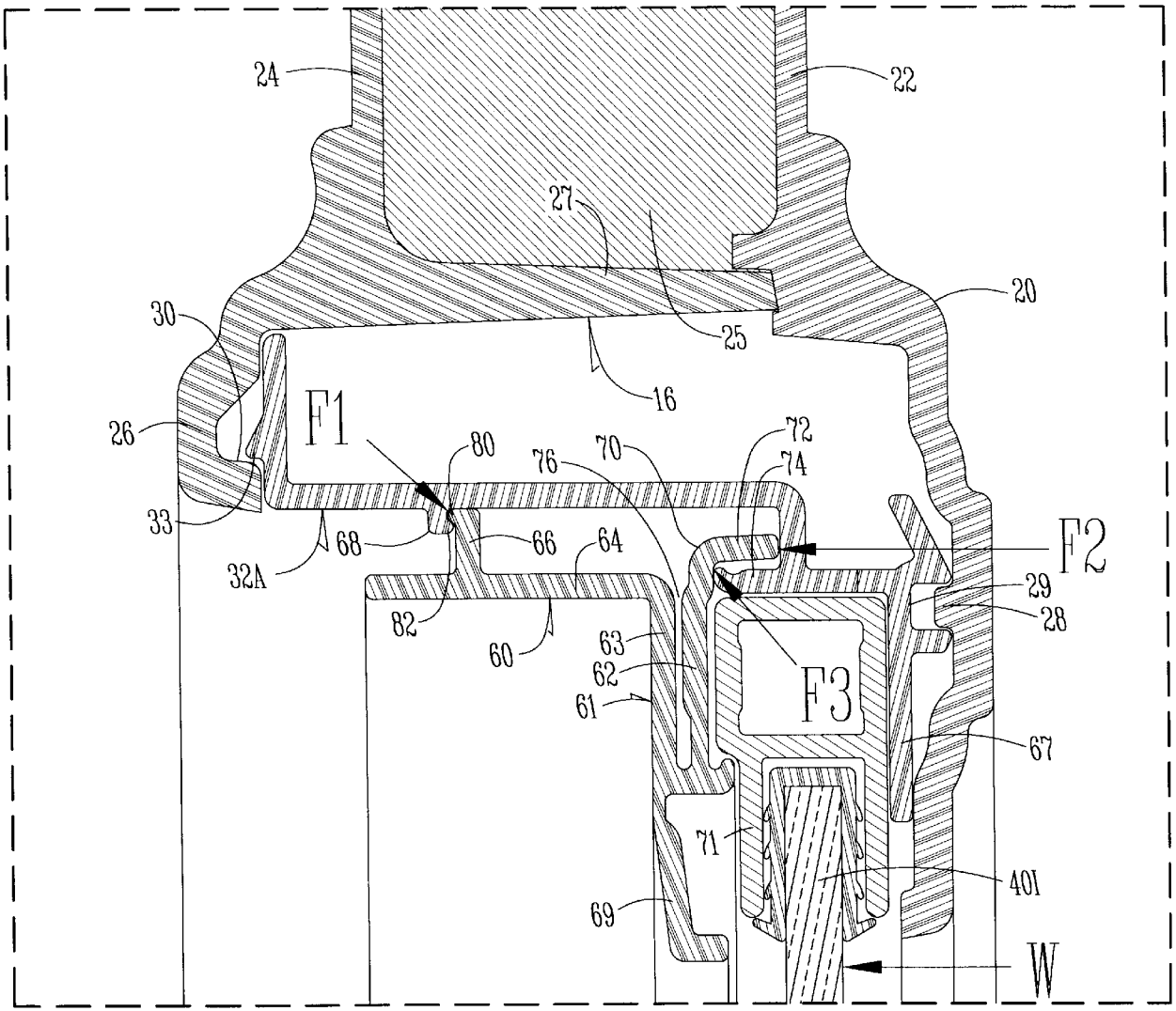

In FIG. 18, a resiliently flexible yet at least semi-rigid L-shaped retainer strip 60 is interposed between the liners 32A and the window 40 to retain it. The retainer 60 is elongated and has a longitudinal axis. The retainer 60 has an upright portion 61 comprising substantially vertical legs 62, 63 joined in an inverted V shape. The inverted V shape provides spring or biasing action at the legs 62, 63.

Leg 63 of the upright portion 61 attaches to a substantially horizontal or lateral leg 64. A second upright portion 66 is spaced laterally from the upright portion 61 and extends downwardly from the other end of the horizontal legs 64 to engage a stop member or second upright portion 68 of the liner 32A. The upright portion 61 is spaced apart from and in opposing relation with the first and second upright portions (walls) 67, 68 of the liners 32. This engagement urges the first upright portion 62 of the retainer strip 60 into engagement with the window 40I.

The upright portion 61, more particularly one of the legs 62 or 63, optionally includes an upper portion which extends upwardly adjacent the window 40. An elongated cover member 69 having a C-shaped cross section extends upwardly from the first leg 62 so as to cover, overlap, or conceal the frame 71 of the window element 40. This cover member 69 allows the window frame 71 to be a different color than the door frame 12 without being noticed. Thus, greater commonality of components can be achieved without detracting from the appearance of the assembled door. For example, a single gray window frame can be produced and used in white or tan door frames. As illustrated in FIGS. 15–18, 20, 22–24, 26, and 30, this option can be utilized in various embodiments of the invention, as needed.

Referring again to FIG. 18, the leg 62 has a lower portion 70 which extends generally opposite the upper portion. The lower portion 70 has a foot or flange 72 at the free end thereof which extends under a generally horizontal ledge or stop member 74 provided on the liner 32A. The retainer strip 60 has a V-shaped notch between the vertical legs 62, 63. This notch allows spring action between the legs 62, 63 and the second upright portion 66 of the strip 60. The retainer strip is biased into engagement with the window 40.

In FIG. 18, the arrows indicate the wind force W on the window 40I and the counteracting forces presented by the installed retainer strip 60. The spring action of the retainer strip 60 creates a force F1 to counteract the urging or biasing of the second upright portion 66 into the wall 68. Protrusions 80, 82 on the upright portions 66 and 68, respectively, help mechanically interlock the strip 60 with the liner 32A. The protrusions or ribs 80, 82 are preferably curved so that they will slide past each when sufficient vertical force is applied. The foot or flange 72 wedges under the ledge 74 and is spring loaded with a force F2 into the liner 32A as shown. The ledge 74 also prevents the flange 72 from moving upward. Thus, counteracting forces F2 and F3 are created. As a result, a "preloaded" resisting force/moment is generated by the installed strip 60. This preload force must be overcome before the strip 60 will deflect or rotate toward the interior in a vertical plane. The strip 60 retains the window 40I better and thus helps prevent air from leaking around the window 40I.

The retainer strip 60 is strong, but resiliently flexible. Preferably the retainer strip is made of a thermoplastic or vinyl material, such as PVC (polyvinylchloride). Such material is durable and does not rust. Preferably the liners 32, 34, 34A, 38 and 38A are also made of a vinyl or a similar thermoplastic material.

FIGS. 17 and 20 show that the jamb liners 38A are also adapted to snap into the channel 16 and have the retainer strip 60 snapped thereonto. However, the jamb liners 38A are shaped differently than the head liner 32A in FIG. 18 in some respects. First, a leg 90 extends downwardly from a substantially horizontal cross member 92. The cross member 92 bends upwardly at one end and connects to a second cross member 94 which is raised above the cross member 92. The connection of the cross member 92, 94 results in a protrusion 96 which extends as shown in FIGS. 17 and 20. The protrusion 96 engages the protrusion 80 on the second upright portion 66 of the retainer strip 60 in substantially the same manner as protrusion 82 does in FIG. 18. Thus, a snap-in connection is formed between the liner and the retainer strip. Second, a leg 98 extends downwardly from the cross member 94. The leg 98 is longer than its counterpart in FIG. 18 in order to reach near the bottom of the channel 16, which is deeper along the jamb sides.

Figure 19:
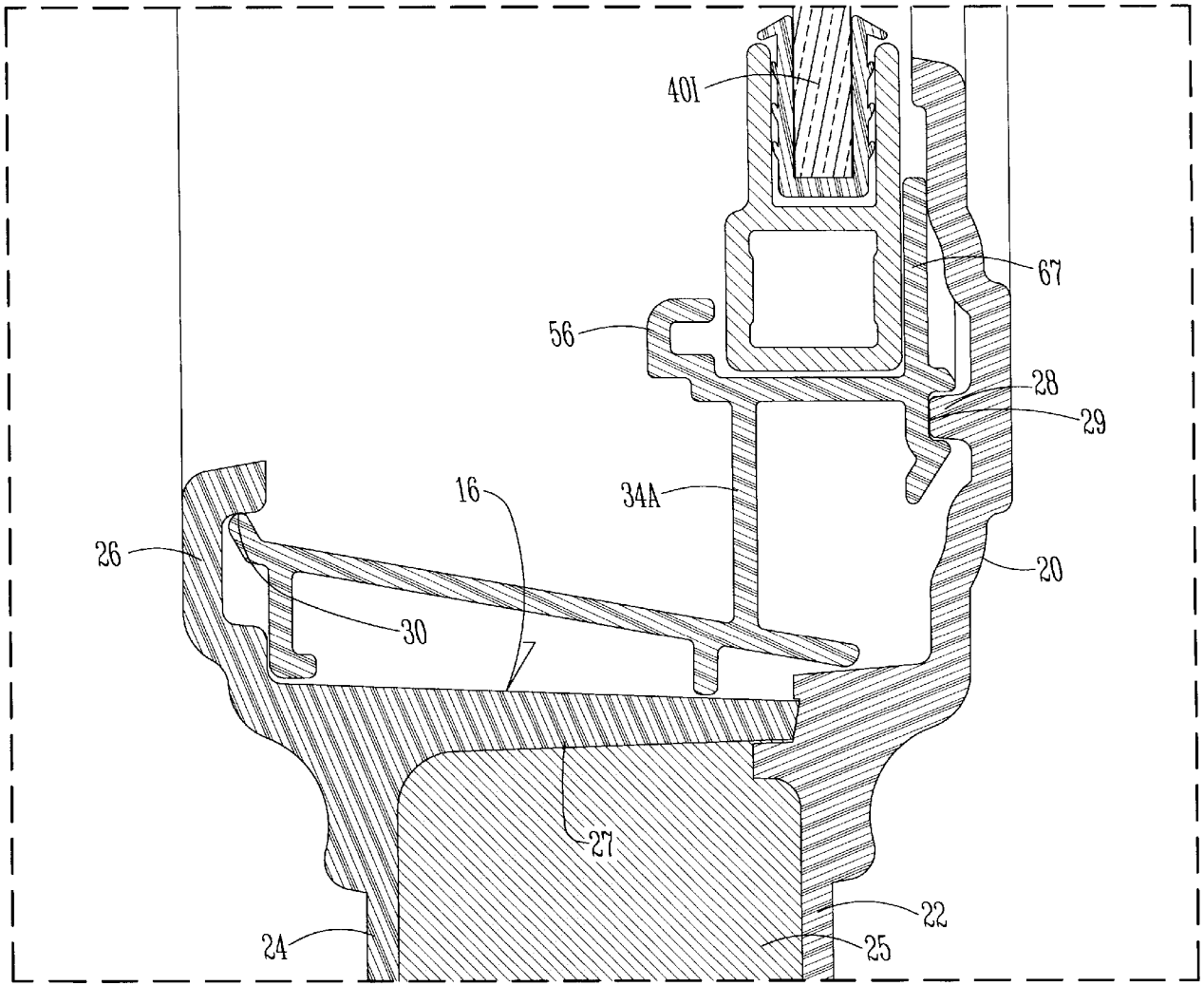

Installation is simple and no tools are required. Once the window element or window 40 is inserted into track I of the liner 32A, the retainer strip 60 is installed around the perimeter, except at the sill liner 34A where the upright portion 56 performs the retaining function (FIG. 19).

It should be noted that a screen 42 can be installed in the full view door during the summer months instead of a window 40. Spring loaded jamb liners are not required to help hold the window element in place in the full view configuration. Instead, the retainer strip is wedged between the liner and the window element to hold the window element in place.

MaxxView Full View

FIGS. 21–31 illustrate a second main embodiment of the present invention. This embodiment is referred to as the MaxxView™ door system. Two sub-embodiments are disclosed herein: a full view configuration and a self-storing configuration. The full-view configuration will be discussed next.

Figure 22:
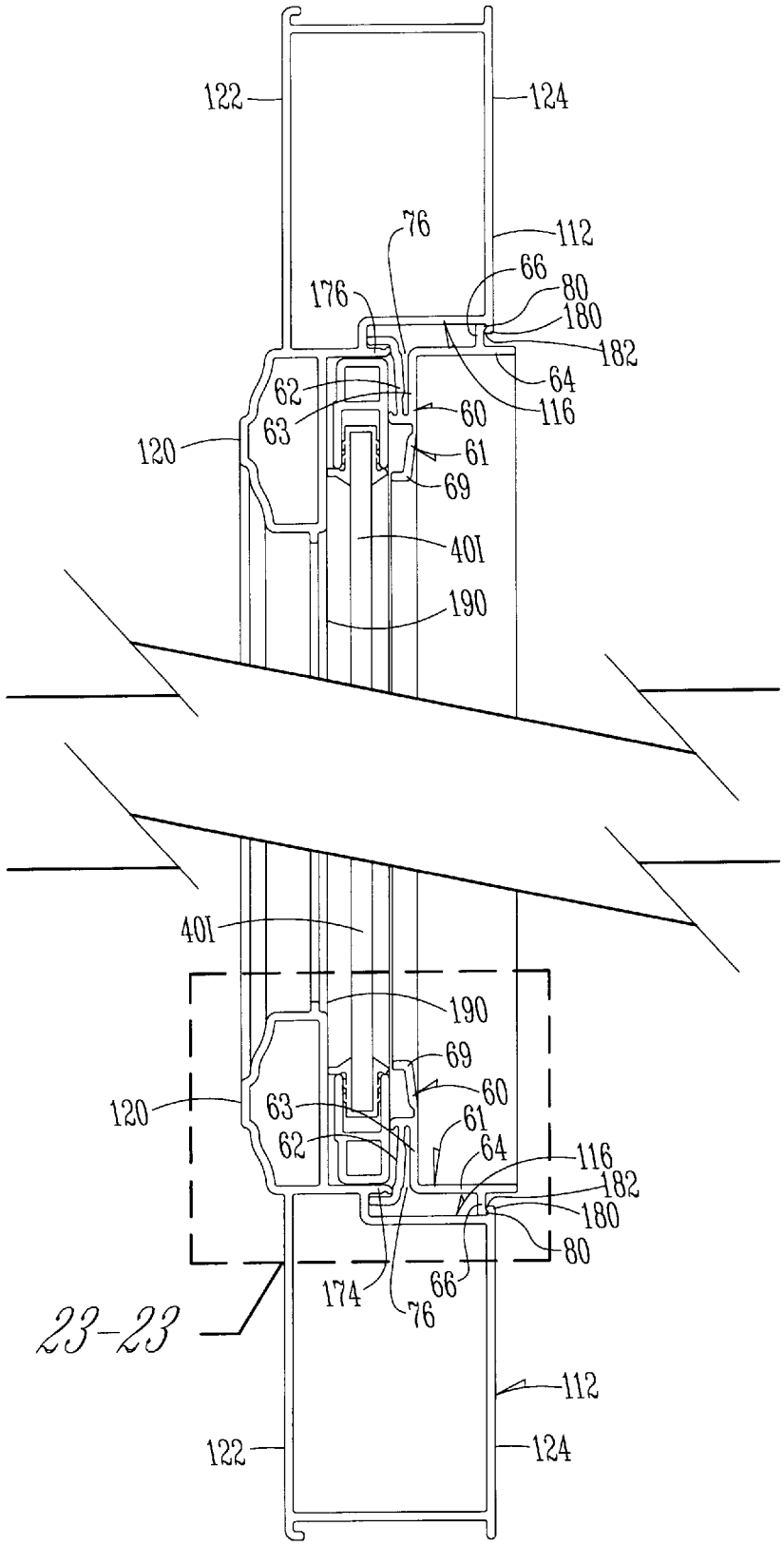
FIG. 22 is a vertical sectional view of the door of FIG. 21 taken along line 22—22. The view has been broken to conserve space and show indeterminate length.

Referring to FIGS. 21–24, the MaxxView™ door system 100 includes a door frame 112 with an opening 114 therein. Preferably the door frame 112 is formed by a seamless aluminum extrusion. The extrusion is cut into sections of appropriate length and mitered together. Thus, the door frame is free of seams in the cross-sectional views shown. The door frame 112 forms a stair-stepped inner peripheral channel 116 around the opening 114, as best seen in FIG. 22. The door frame 112 has a window supporting ledge 174 extending inwardly in a generally horizontal direction. A molding member 120 extends inwardly into the opening 114 at the exterior of the door frame 112. A window 40 can be positioned against the upright back side or wall 190 of the molding member 120.

Figure 23:
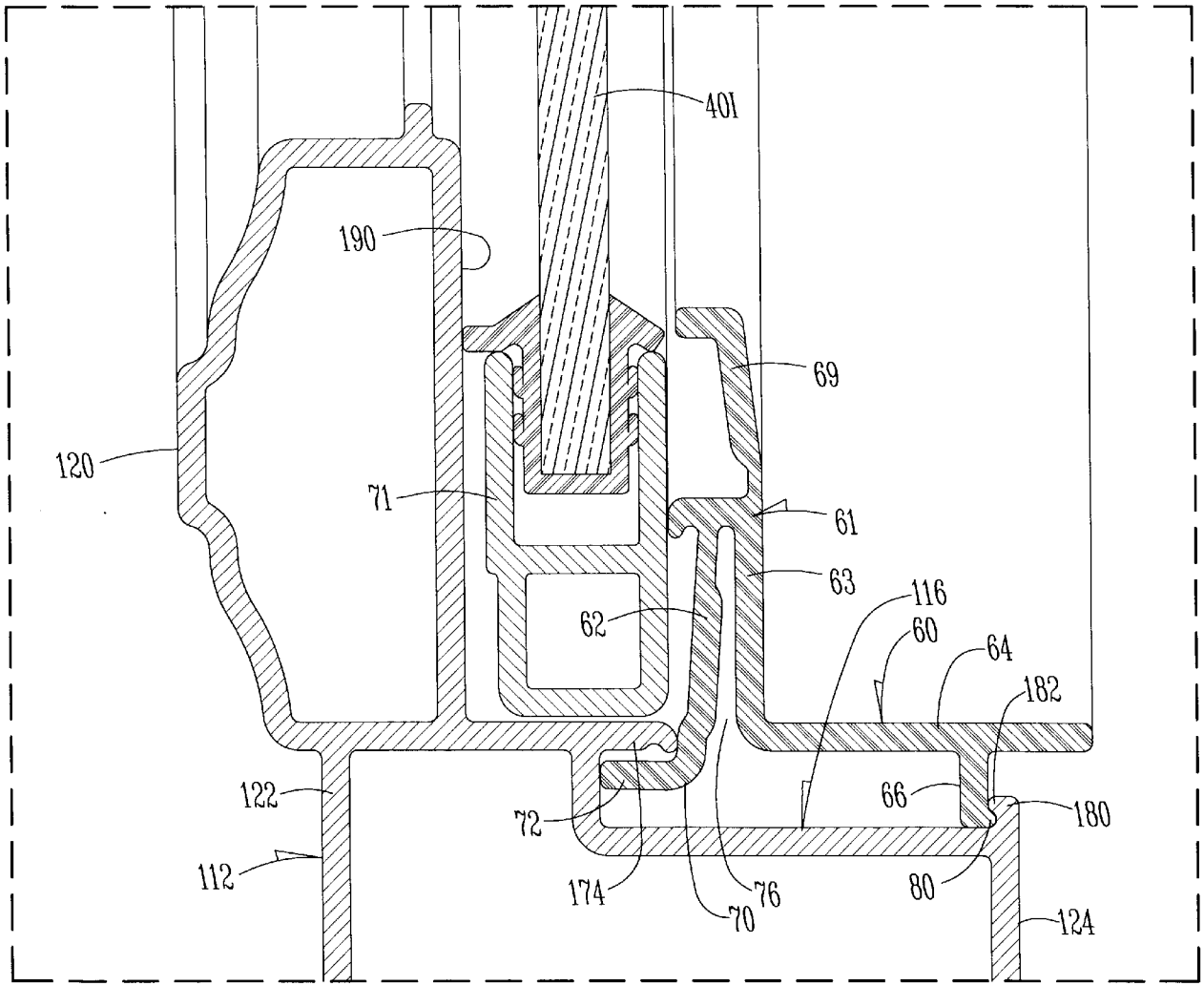
FIG. 23 is an enlarged sectional view of the area denoted 23—23 in FIG. 22.
Figure 24:
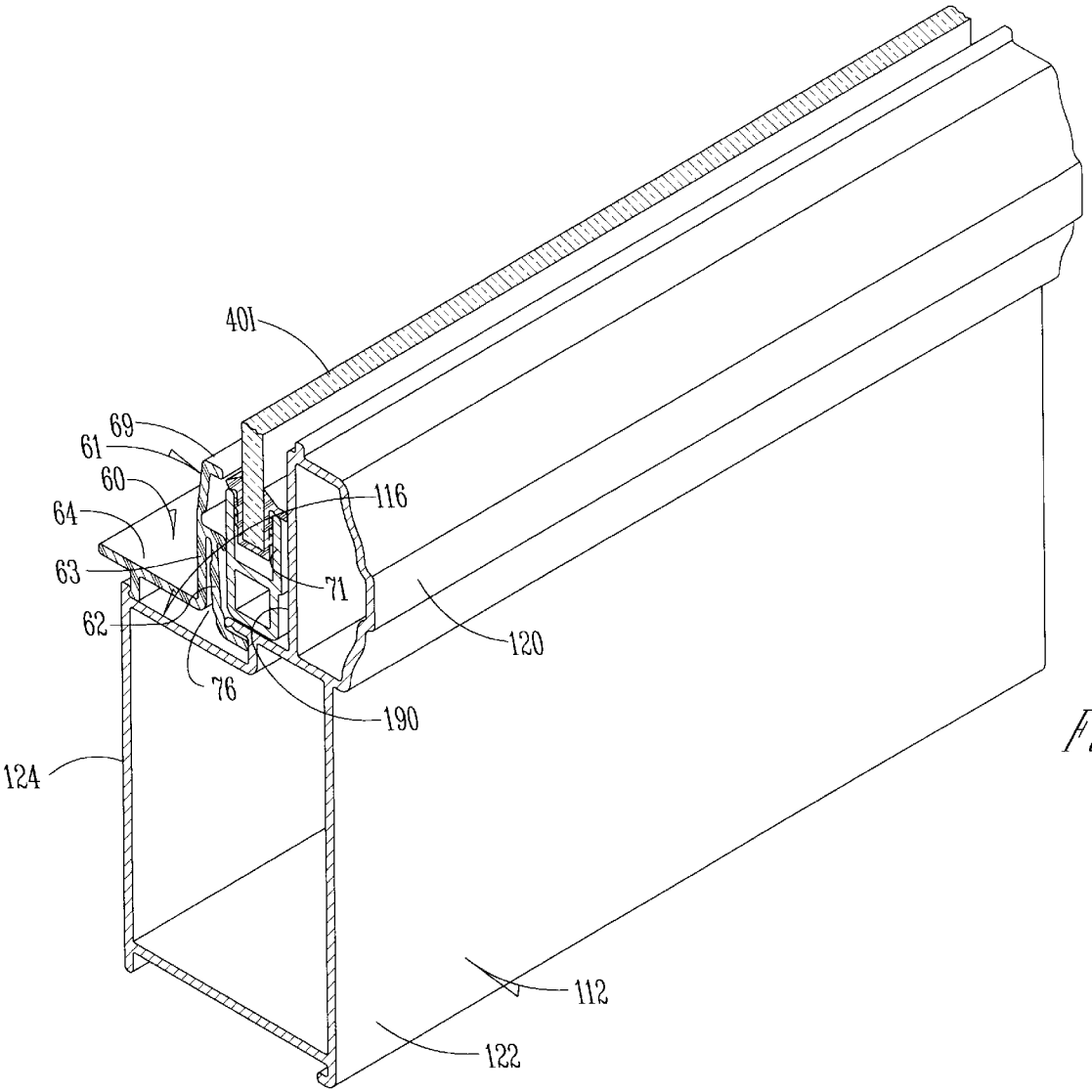
FIG. 24 is an enlarged perspective view of a portion of the extruded door frame of FIG. 21 with the window and window retainer installed therein.

A retainer strip 60 is yieldingly interlocked between the window 40 and the door frame 112, as shown in FIG. 23 and previously described with reference to the other embodiments except that a liner is not required. The door frame 112 has an upright member 180 extending upwardly from the interior wall 124. A protrusion 182 extends toward the exterior wall 122 and interlocks with the protrusion or rib 80 on the upright 66 to secure the strip 60. The strip 60 retains the window 40I against the back side 190 of the door frame molding 120.

Maxxview Self-storing

Figure 25:
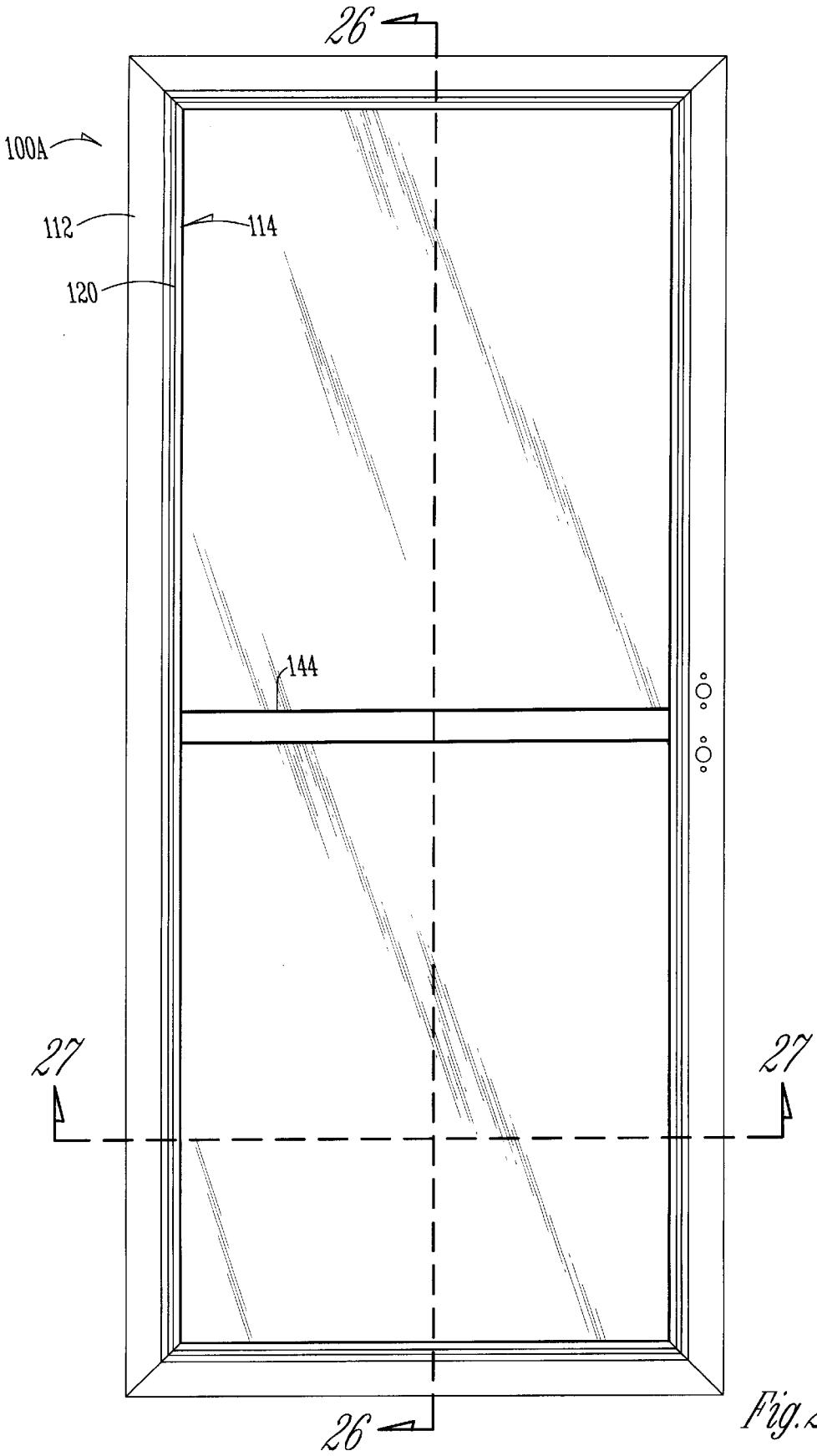
FIGS. 25–31 illustrate the embodiment of FIGS. 21–24 applied to an extruded door frame having "self-storing" window elements.
Figure 26:
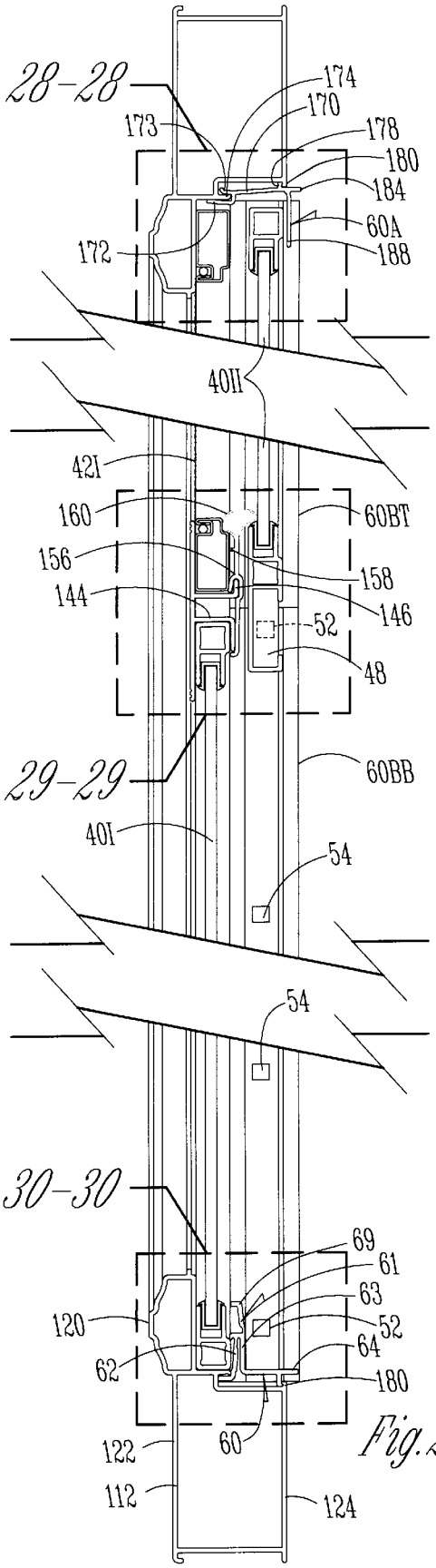
Figure 27:
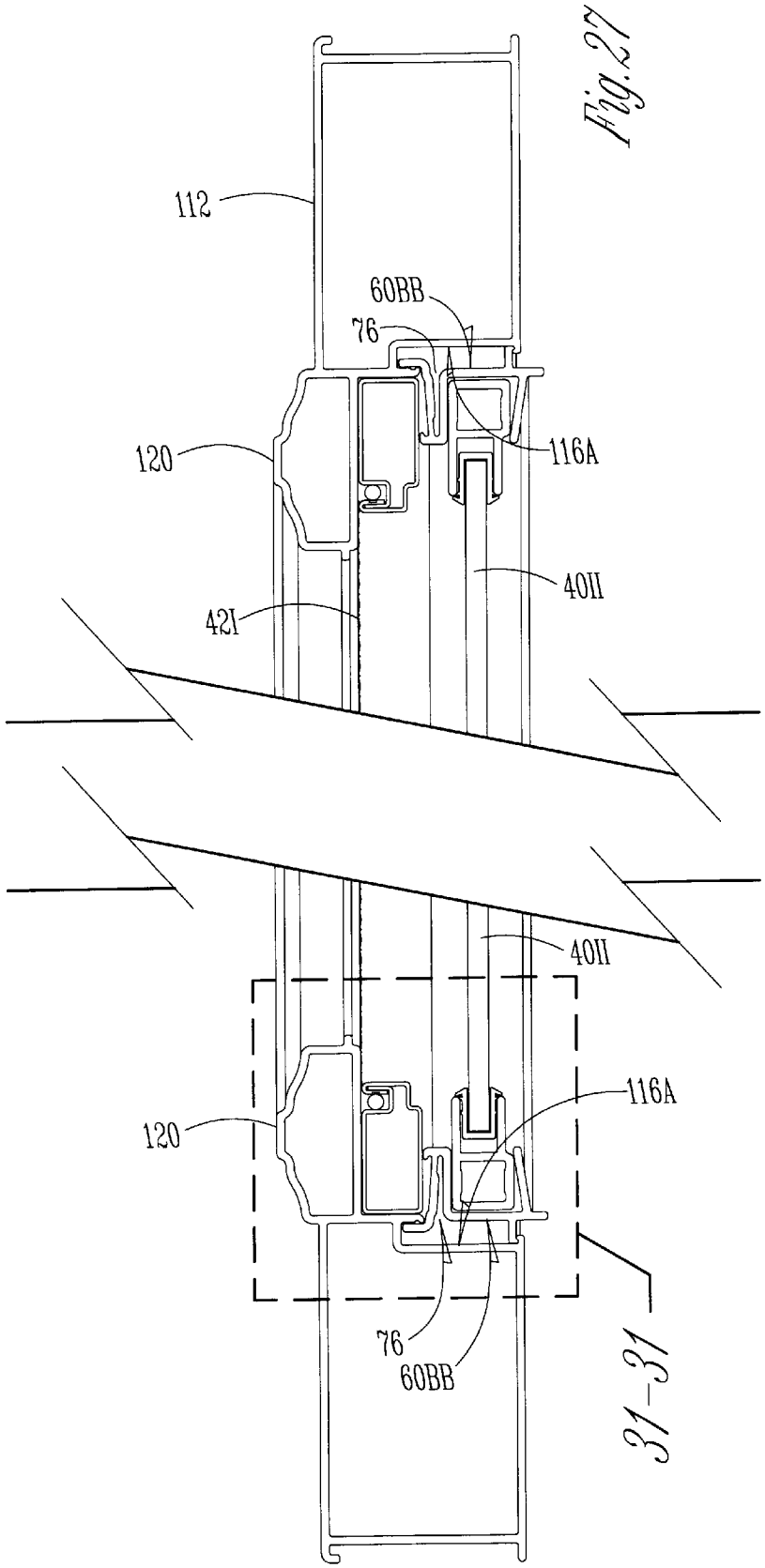
Figure 28:
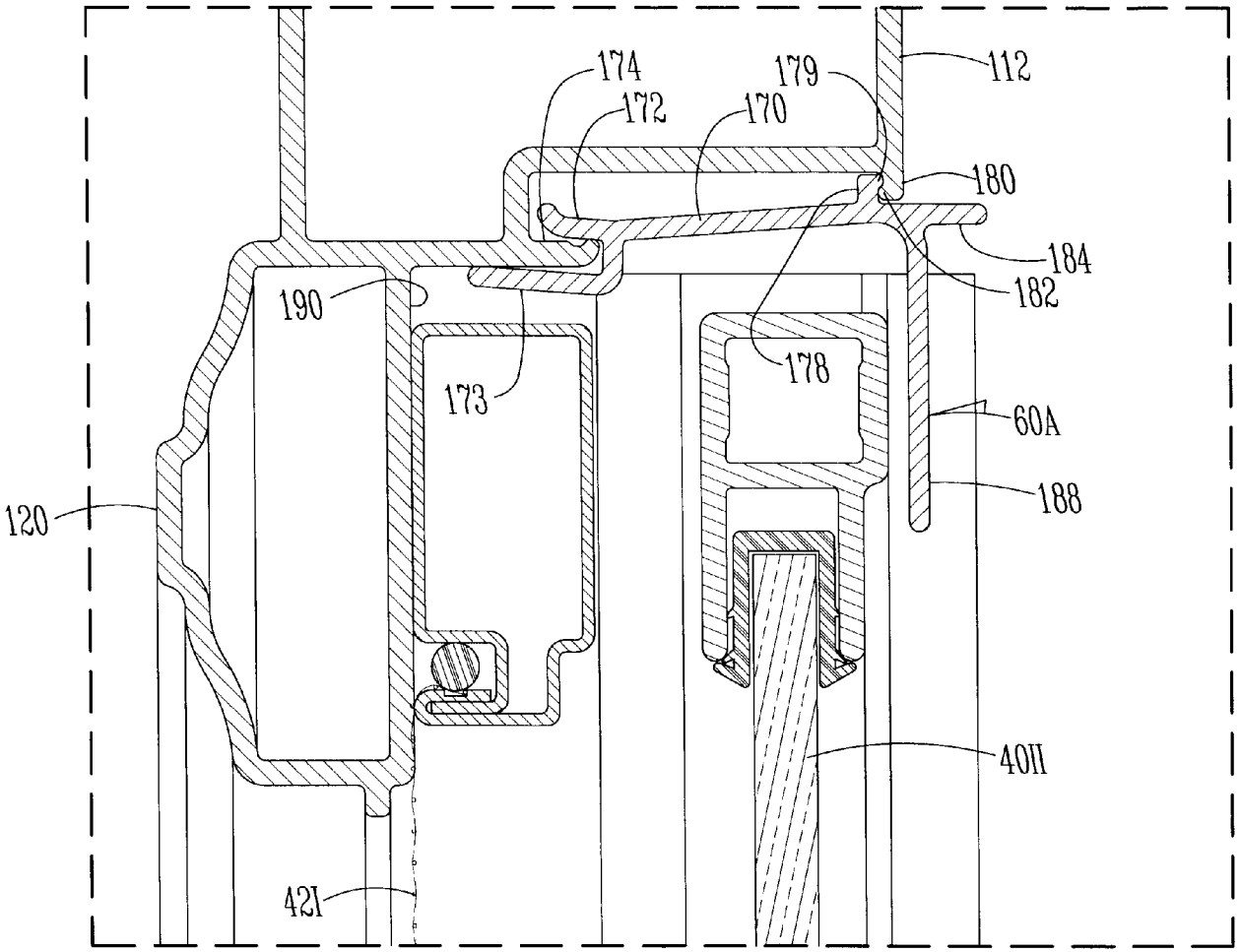
Figure 29:
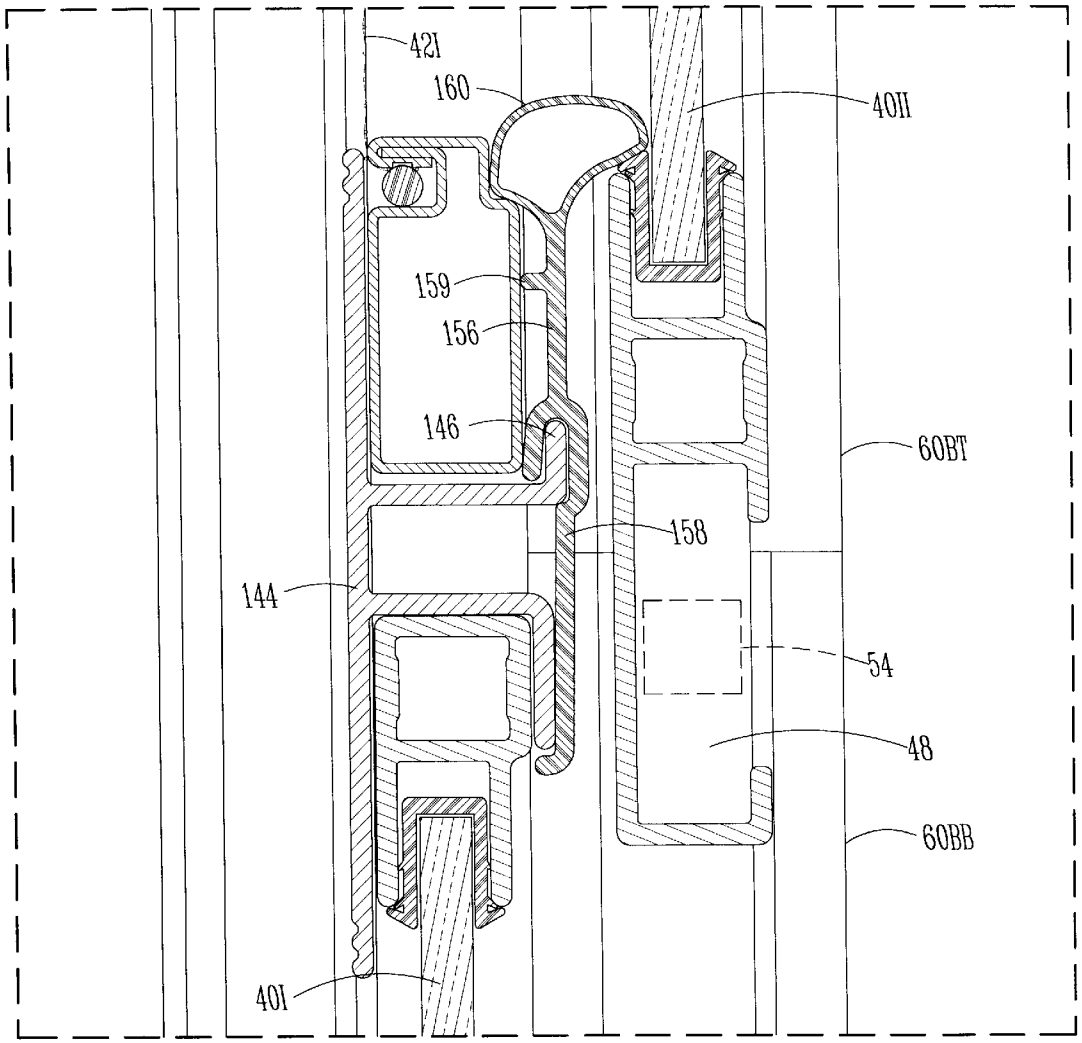
Figure 30:
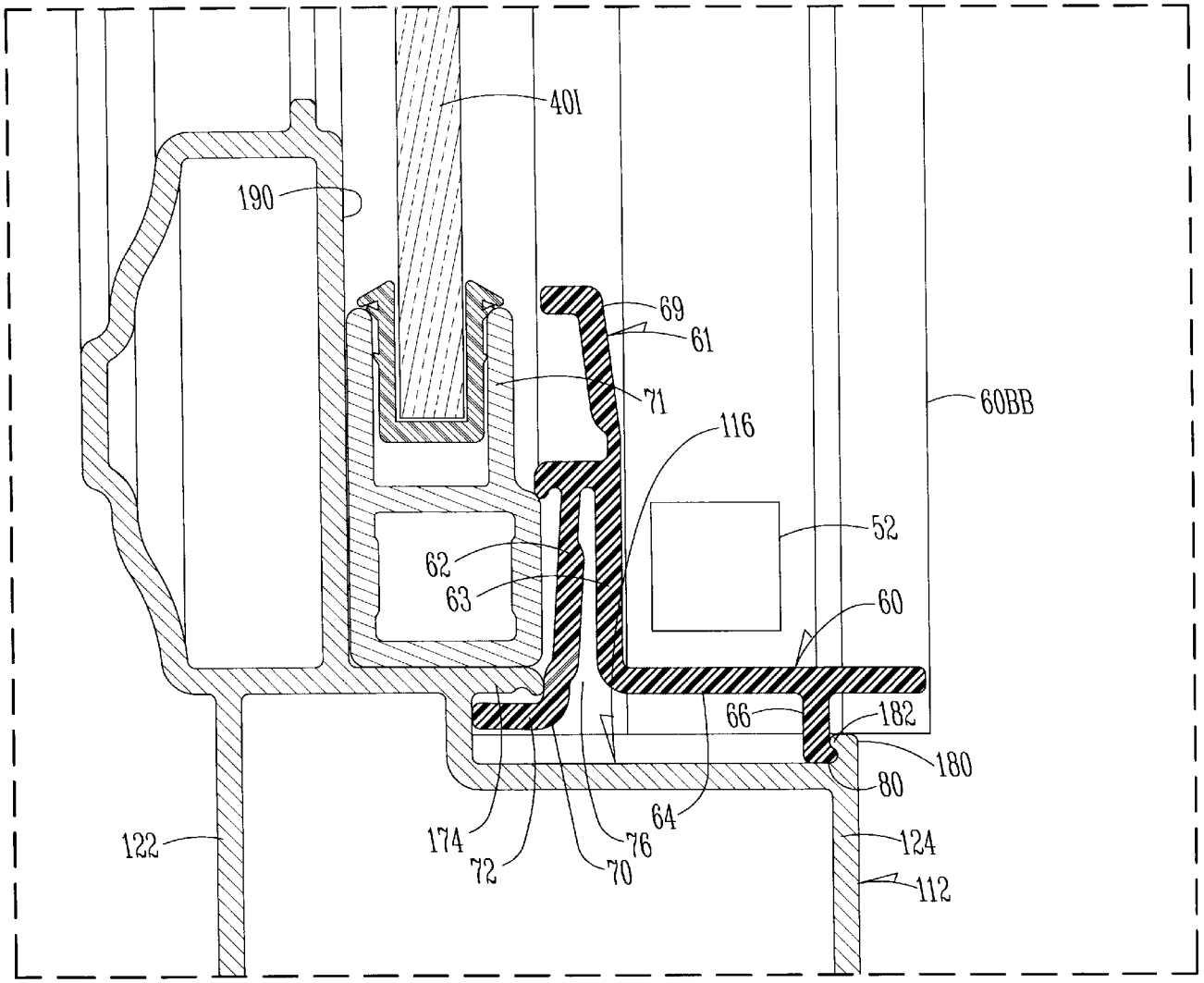
Figure 31:
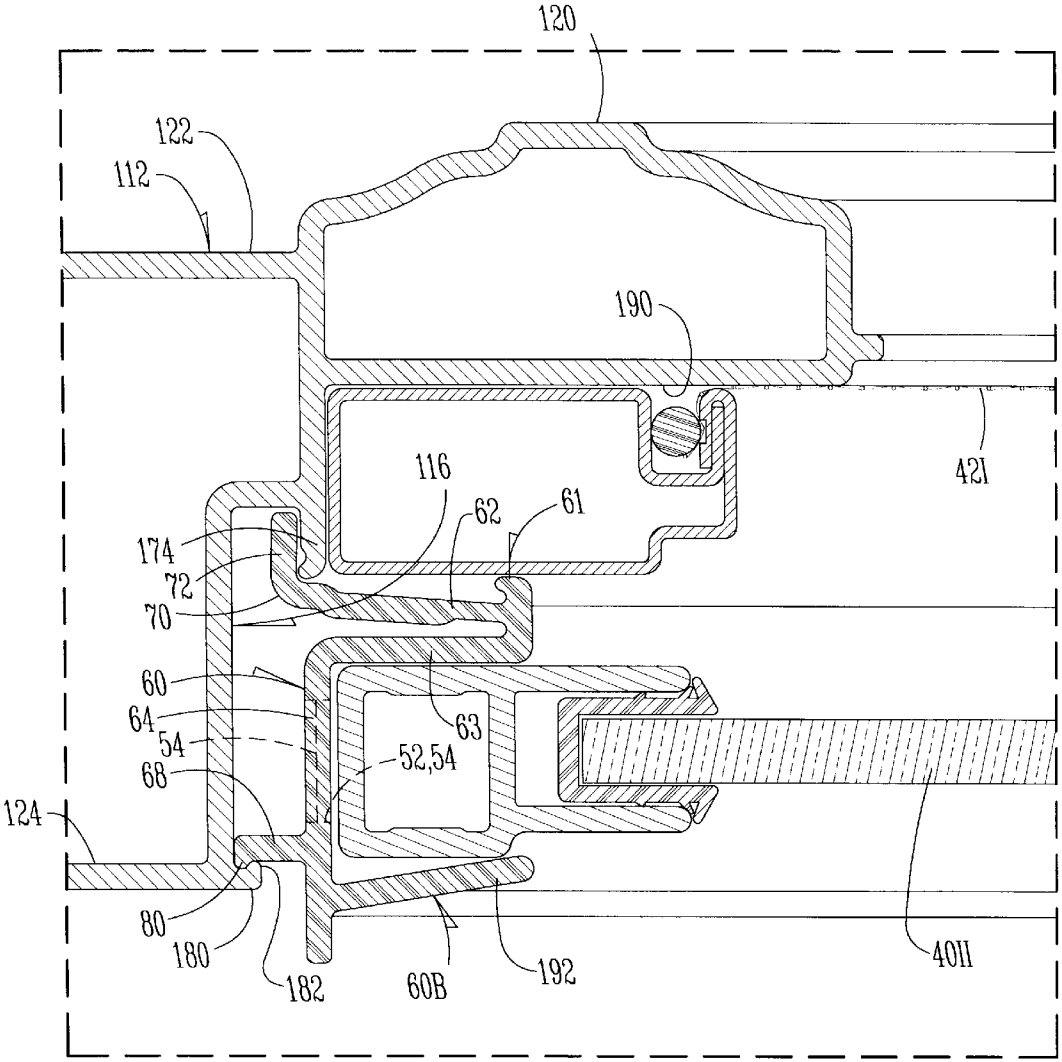

A self-storing configuration 100A that is possible with the MaxxView™ door system is illustrated in FIGS. 25–31. In FIG. 25, the MaxxView™ door frame 112 has an opening 114 therein for receiving window elements. Referring to FIG. 26, window elements are disposed in track I, but the window 40I is positioned in the bottom of track I of the opening 114 and the screen 42I is positioned on top of the window 40I. A center mullion 144 extends horizontally across the opening 114, as shown in FIGS. 25 and 29. The center mullion 144 is H-shaped in cross section. It wraps around and is interposed between the upper portion of the window 40I and the lower portion of the screen 42I. A truncated upright leg 146 of the mullion 144 extends between the screen 42I and a movable window 40II disposed in track II.

A seal 156 is operatively interposed between those same two window elements. The seal 156 comprises a substantially rigid bracket member 158 which slips onto the leg 146 of the center mullion 144. The screen 42I wedges the bracket member 158 onto the leg 146 and prevents the bracket member 198 from dislodging under normal conditions. The seal 156 extends horizontally across the opening 114 along with the center mullion 144. An elongated elastomeric hollow bead 159 mounts on the top of the bracket 158 and extends across the opening 114. The hollow bead 159 is sized so that it sealingly contacts the adjacent window elements as shown in FIG. 29. This forms a dam that prevents water from welling up in the channel between the window elements 40IIT and 42IT. Instead, the water tends to drain back to the exterior through the screen 42IT.

The inner window elements are retained in part by the retainer 60B at the sill (FIG. 30) and a retainer 60A at the head FIG. 28). The retainer 60A at the head is generally L-shaped, but has a main horizontal member 170 having two spaced apart legs 172, 173 at a forked end thereof. The legs 172, 173 straddle the ledge 174 protruding from the door frame 112.

A vertical leg 178 protrudes from the main horizontal leg 170 and interlockingly engages an upright stop member 180 on the door frame 112. See protrusions or ribs 179 and 182. A small horizontal flange 184 extends from the intersection of the main horizontal leg 170 and a vertical leg 178. The flange 184 is adapted to be grabbed by hand during installation and removal. A relatively large flange or upright member 188 extends downwardly from the horizontal member 170 so as to loosely retain a window element thereinside. Thus, the retainer 60A essentially forms a second track (II) into which window elements can be inserted, slid, and retained. The sill retainer 60 is essentially identical to the retainer 60 discussed earlier.

The retainers 60B are utilized on both jamb sides as shown in FIG. 27. The jamb retainer 60B (FIG. 31) includes an inboard upright member 192 so as to define track II along the jamb sides and retain the inner window element 40II therein. Member 192 is slanted inwardly for better guidance of the window 40II.

To facilitate installation of the window elements, the jamb retainers 60B are split into separate upper 60BT and lower 60BB parts, as best seen in FIG. 29. Thus, the upper window elements can be loaded in the lower part 60BB of the jamb retainers. The upper parts 60BT can then be positioned thereabove. The upper window elements can be raised into their proper places. The head retainer 60A is installed. Next, the lower window elements, with the mullion 44 and seal 156 installed thereon, can be inserted below.

Depressions 54 and through notches 52 can be included on the retainer strips 60B, as best seen in FIGS. 26 and 29, to established predetermined increments of movable window height adjustments. It will be appreciated that FIGS. 32 and 33 (and the description thereof above) disclose the necessary structure of the strips/jamb liners 60B and the latching mechanism 48 with latch bar 53. For the purpose of brevity, said description will not be repeated here.

Thus, the self-storing MaxxView™ door has a retention system that allows one or more stationary window elements to be installed in track I and a movable window element to be installed in track II. This provides adjustable ventilation area.

One of the advantages of the window retention system of the present invention is that the window elements can be easily installed, removed, and interchanged without tools. For instance, it is easy to convert between the MaxxView™ full view and self-storing configurations.

Thus, the present invention at least satisfies its stated objectives.

The invention has been described in terms of its preferred embodiments. However, it should be understood that modifications and substitutions of equivalents can be made without detracting from the invention as claimed below.

What is claimed is:

1. A window retention system, comprising:

a door frame having an exterior panel, an interior panel, and an opening extending therethrough so as to define an inner peripheral channel between the opening and the door frame;

the channel including a pair of spaced and substantially parallel walls protruding into the opening, a first wall of the pair of walls extending from the exterior panel and a second wall of the pair of walls extending from the interior panel, the first wall extending farther into the opening than the second wall, whereby the first wall is adapted to limit movement of a window element in an exterior direction after the window element is inserted into the opening and past the second wall from an interior panel side of the door;

a resiliently flexible window retainer strip yieldably and detachably mounted on the door frame between the second wall and the window element for retaining the window element in the opening;

the channel further including first and second spaced apart stop members thereon for engaging the retainer strip and thereby limiting movement thereof in two generally opposing directions;

the strip having a longitudinal axis and including a first upright portion spaced apart from and in an opposing relation with the first wall so as to delimit a first track in the channel and retain the window element therein, a second upright portion of the strip laterally spaced from the first upright portion of the strip, the second upright portion of the strip being biased toward and yeildingly interlocking with the second stop member in a mounted state, and a flange extending from the first upright portion of the strip to engage the first stop member and thereby limit movement of the first upright portion of the strip in one direction;

the first upright portion of the retaining strip comprising a spring member form by first and second legs joined together in an inverted V shape in a free state, each leg having a free end that springs apart from the other leg with an outward biasing force when the legs are forced inwardly and yieldingly interlocked against the first and second stop members in the channel;

the free end of the second leg having a lateral portion extending therefrom; and the lateral portion having an exposed free end which allows both installation and removal of the strip.

2. The window element retention system of claim 1 wherein the first and second legs are substantially vertical and the lateral portion is substantially horizontal.

3. The window element retention system of claim 1 wherein the lateral portion is integrally attached to the second leg and the second upright portion of the strip extends from the lateral portion so as to be yieldingly and interlockingly engagable with the second stop member.

4. The window element retention system of claim 3 wherein the second stop member and the second upright portion of the strip both have a rib thereon protruding therebetween for lockingly interlocking the strip with the second stop member.

5. The window element retention system of claim 4 wherein the ribs have a curved profile so as to allow the ribs to slide past each other to interlock and to release.

6. The window retention system of claim 1 wherein the flange extends forwardly of the first upright portion of the strip and engages the first stop member.

7. The window element retention system of claim 1 wherein the first stop member comprises a ledge on the channel for stopping rotation of the flange in one direction.

8. The window element retention system of claim 1 wherein the first wall of the channel comprises a back side of a molding member integrally formed on the exterior panel.

9. The window element retention system of claim 1 wherein the door frame comprises a perimetric frame formed by a plurality of sides joined together at mitered joints, each of the sides being formed of an elongated extrusion having a continuous transverse cross section between the joints.

10. The window element retention system of claim 1 wherein the opening in the door frame defines a pair of opposing jamb sides, a head, and a sill.

11. The window element retention system of claim 10 wherein the retainer strip extends along the head and the sill in the opening of the door frame.

12. The window element retention system of claim 10 wherein the retainer strip extends along the head, sill, and jamb sides of the door frame.

13. The window element retention system of claim 1 wherein the retainer strip is constructed of a thermoplastic material.

14. The window retention system of claim 1 wherein the first and second legs of the strip are joined together at a single apex to form a single inverted V shape.

* * * * *